US010513858B2

(12) United States Patent
Do Carmo Pacheco et al.

(10) Patent No.: US 10,513,858 B2
(45) Date of Patent: Dec. 24, 2019

(54) CONSTRUCTION PROCESS OF STRUCTURES WITH EMPTY SEGMENTS AND CONSTRUCTION SYSTEM OF STRUCTURES WITH EMPTY SEGMENTS

(71) Applicant: PGPI—MARCAS E PATENTES, S.A., Matosinhos (PT)

(72) Inventors: Pedro Alvares Ribeiro Do Carmo Pacheco, Matosinhos (PT); David Fernandes Martins Ramos, Rio Tinto (PT); Diogo Teixeira Graca Moura, Nevogilde (PT); Hugo Edgar Norberto Soares Coelho, Lugar de Capelos (PT); Pedro Henrique Baptista Borges, Pedroso (PT)

(73) Assignee: PGPI—MARCAS E PATENTES, S.A, Matosinhos (PT)

( * ) Notice: Subject to any disclaimer, the term of this patent is extended or adjusted under 35 U.S.C. 154(b) by 0 days.

(21) Appl. No.: 15/500,729

(22) PCT Filed: Jul. 29, 2015

(86) PCT No.: PCT/PT2015/050002
§ 371 (c)(1),
(2) Date: May 17, 2017

(87) PCT Pub. No.: WO2016/018166
PCT Pub. Date: Feb. 4, 2016

(65) Prior Publication Data

US 2017/0275901 A1 Sep. 28, 2017

(30) Foreign Application Priority Data

Jul. 31, 2014 (PT) ..... 107822

(51) Int. Cl.
*E01D 21/00* (2006.01)
*E04G 9/00* (2006.01)
(Continued)

(52) U.S. Cl.
CPC ..... *E04G 9/00* (2013.01); *E01D 19/00* (2013.01); *E01D 19/02* (2013.01); *E01D 21/00* (2013.01);
(Continued)

(58) Field of Classification Search
CPC ..... E04G 9/00; E04G 13/04; E04G 13/00; E01D 19/02; E01D 19/00; E01D 21/00;
(Continued)

(56) References Cited

U.S. PATENT DOCUMENTS 1,299,729 A * 4/1919 Hubbell ..... B28B 7/168 405/4
1,888,181 A * 11/1932 Riesbol ..... E04G 13/04 249/137
(Continued)

FOREIGN PATENT DOCUMENTS

DE 25 20 105 A1 11/1976
EP 2 088 244 A1 8/2009
JP 2008274637 A * 11/2008

OTHER PUBLICATIONS

International Search Report for PCT/PT2015/050002 dated Dec. 3, 2015 [PCT/ISA/210].
(Continued)

*Primary Examiner* — Brent W Herring
(74) *Attorney, Agent, or Firm* — Sughrue Mion, PLLC

(57) ABSTRACT

An industrialized construction process is provided in which the filling material (8) is poured in situ on empty segments (3) prefabricated ex situ.
The process comprises the prefabrication of empty segments (3) including the assembling of steel reinforcement elements
(Continued)

(9) and assembling fixing elements (4) whereby these comprise rigid elements (22) and at least part of the moulds (13), which occur at a location (5) ex situ; transport and placement of the empty segments (3) in the final position in the structure (1); pouring the filling material (8); consolidation or curing of the filling material; prestressing the structure (1); and removal of the moulds (13) and fixing elements (4). The present invention also relates to a construction system adapted for carrying out the construction process.

12 Claims, 24 Drawing Sheets

(51) Int. Cl.

| | |
|---|---|
| ***E01D 19/00*** | (2006.01) |
| ***E01D 19/02*** | (2006.01) |
| ***E04B 1/22*** | (2006.01) |
| ***E04C 5/08*** | (2006.01) |
| ***E04C 5/10*** | (2006.01) |
| ***E04C 5/12*** | (2006.01) |
| ***E04G 13/00*** | (2006.01) |
| ***E04G 13/04*** | (2006.01) |

(52) U.S. Cl.
CPC ..... *E04B 1/22* (2013.01); *E04C 5/08* (2013.01); *E04C 5/10* (2013.01); *E04C 5/12* (2013.01); *E04G 13/00* (2013.01); *E04G 13/04* (2013.01)

(58) Field of Classification Search
CPC ... E01D 2101/26; E01D 2101/28; E04B 1/22; E04C 5/12; E04C 5/08; E04C 5/10
USPC ..... 52/742.14, 2.15, 508, 259, 260
See application file for complete search history.

(56) References Cited

U.S. PATENT DOCUMENTS 2,708,780 A * 5/1955 Burkhalter ..... B28B 7/22 249/154
3,049,786 A * 8/1962 Jones ..... B28B 1/084 425/111
3,571,835 A * 3/1971 Buechler ..... E01D 21/00 14/77.1
3,882,564 A * 5/1975 Muller ..... E01D 21/105 14/77.1
3,999,735 A * 12/1976 Brownlee ..... E04B 1/215 249/19
4,104,844 A * 8/1978 Brownlee ..... E04B 1/21 249/19
4,426,949 A * 1/1984 Knutsen ..... B63C 1/02 114/47
4,573,303 A * 3/1986 Figari ..... E04B 5/263 264/35
4,604,841 A * 8/1986 Barnoff ..... E01D 2/02 14/73
5,425,152 A * 6/1995 Teron ..... E01D 2/00 14/24
5,577,284 A * 11/1996 Muller ..... E01D 2/00 14/73
6,101,779 A * 8/2000 Davenport ..... E04B 1/04 52/223.6
6,345,403 B1 * 2/2002 Nagle ..... E01D 2/02 14/77.1
7,197,854 B2 * 4/2007 Bettigole ..... E01D 19/125 52/333
8,109,691 B2 * 2/2012 Clark ..... E01C 5/10 404/72
8,375,676 B2 * 2/2013 Takakura ..... E04B 5/40 52/414
8,640,292 B1 * 2/2014 Sorkin ..... E01D 19/14 14/18
8,671,641 B2 * 3/2014 Takakura ..... E04B 5/40 52/414
9,604,416 B2 * 3/2017 Sorkin ..... B28B 7/28
9,751,236 B2 * 9/2017 Daul ..... B28B 7/02
9,982,434 B1 * 5/2018 Crigler ..... E04C 5/122
2005/0102951 A1 * 5/2005 Bennett ..... E04C 5/08 52/633
2005/0115195 A1 * 6/2005 Bettigole ..... E01D 19/125 52/782.1
2007/0028552 A1 * 2/2007 DeLoach, Sr. ..... E04B 1/41 52/677
2010/0088985 A1 * 4/2010 Mellier ..... E01D 21/10 52/223.13
2010/0275545 A1 * 11/2010 Kumpf ..... B28B 1/42 52/588.1
2011/0041433 A1 * 2/2011 He ..... E01D 2/02 52/223.7
2011/0194897 A1 * 8/2011 Clark ..... E01C 5/10 404/70
2012/0282025 A1 * 11/2012 French ..... B28B 7/186 404/45
2015/0252558 A1 * 9/2015 Chin ..... E04H 9/02 52/79.7
2015/0330079 A1 * 11/2015 Sorkin ..... B28B 7/28 249/188
2016/0305077 A1 * 10/2016 Shamsai ..... E04C 3/26
2016/0319541 A1 * 11/2016 Sanabra ..... E04C 5/08
2017/0037624 A1 * 2/2017 Sorkin ..... E04C 5/122
2017/0152660 A1 * 6/2017 Sorkin ..... E04C 5/16
2017/0275881 A1 * 9/2017 Sorkin ..... E04C 5/12
2018/0050467 A1 * 2/2018 Kloet ..... B28B 7/0091
2019/0010695 A1 * 1/2019 Zavitz ..... E04B 5/17

OTHER PUBLICATIONS

Written Opinion for PCT/PT2015/050002 dated Dec. 3, 2015 [PCT/ISA/210].

* cited by examiner

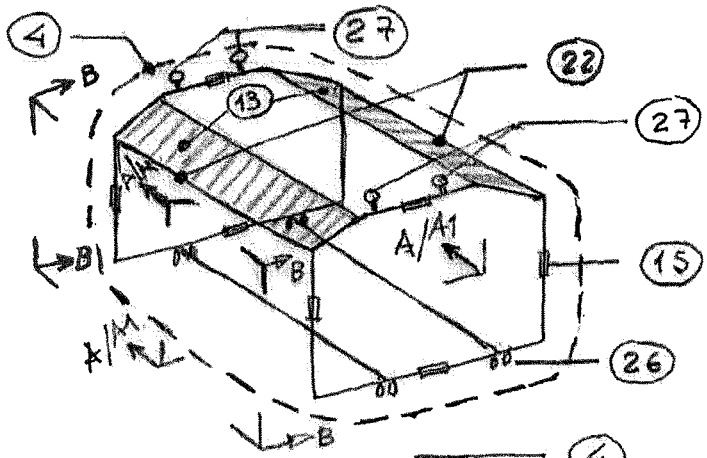
Fig. 9a
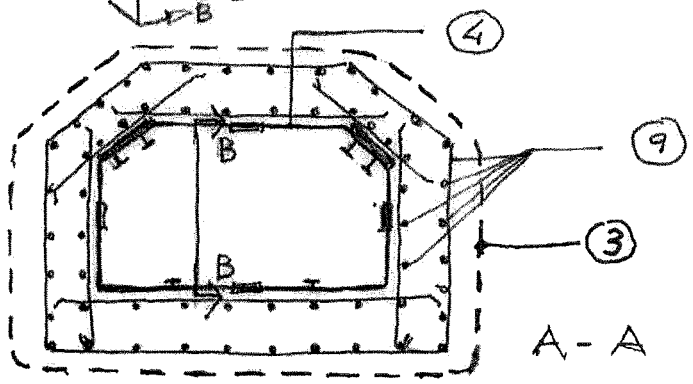
Fig. 9b
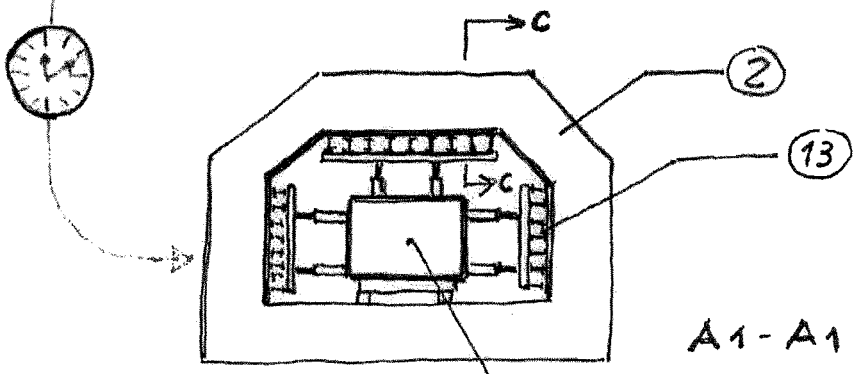
Fig. 9c
Fig. 9d
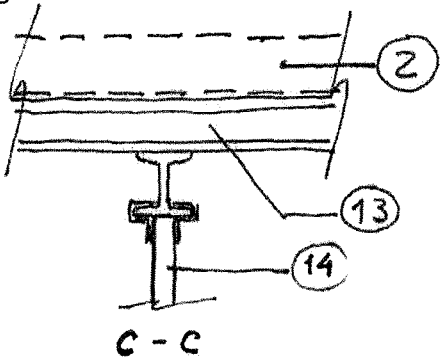
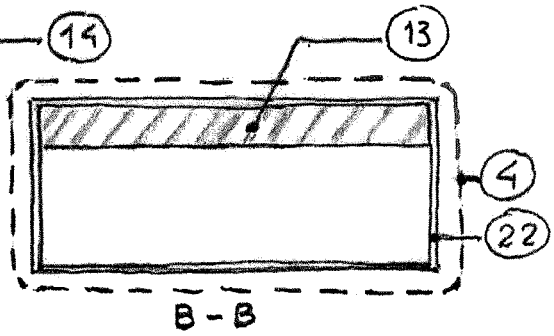
Fig. 9e Fig. 11a
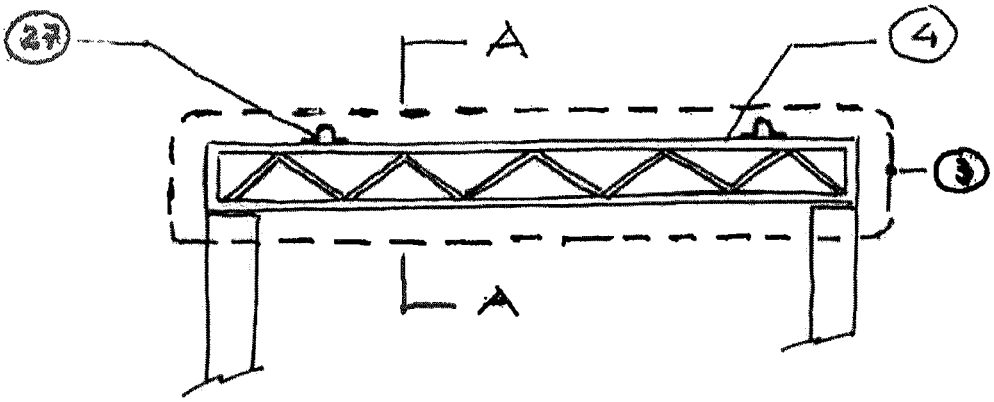
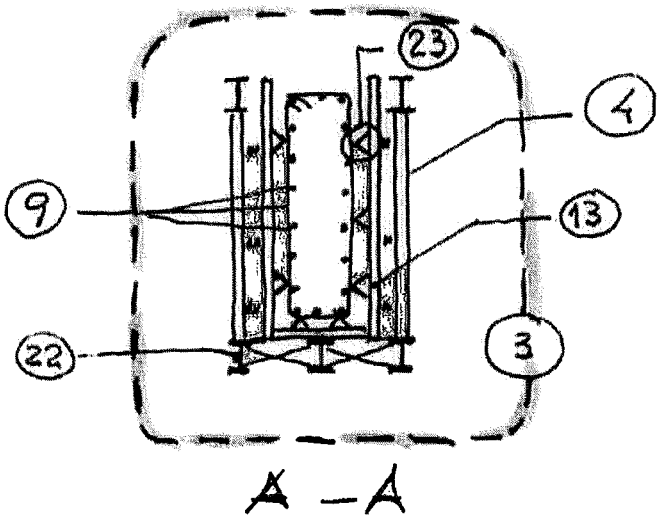
Fig. 11b Fig. 12a
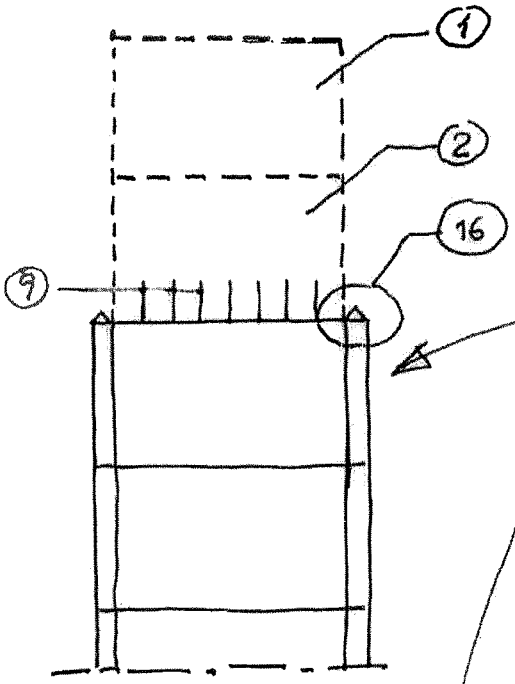
Fig. 12b
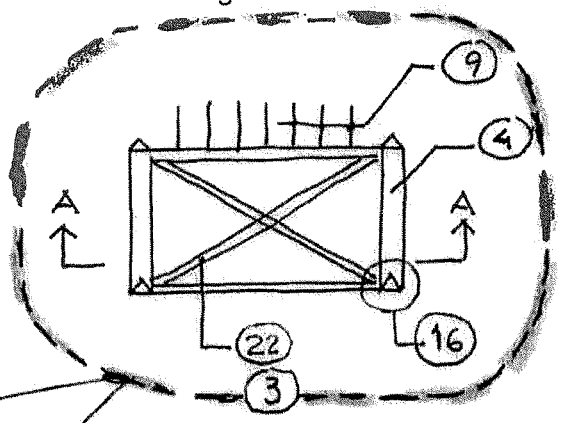
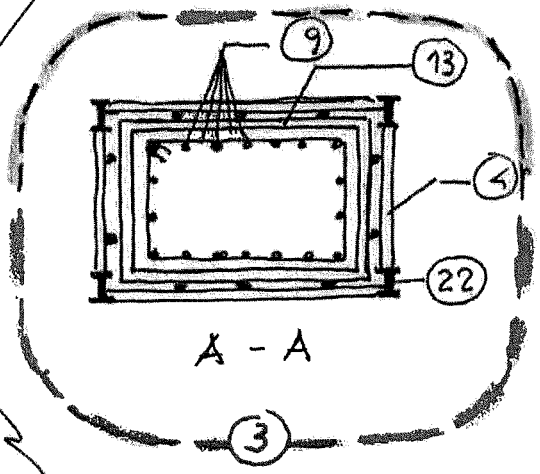
Fig. 12c
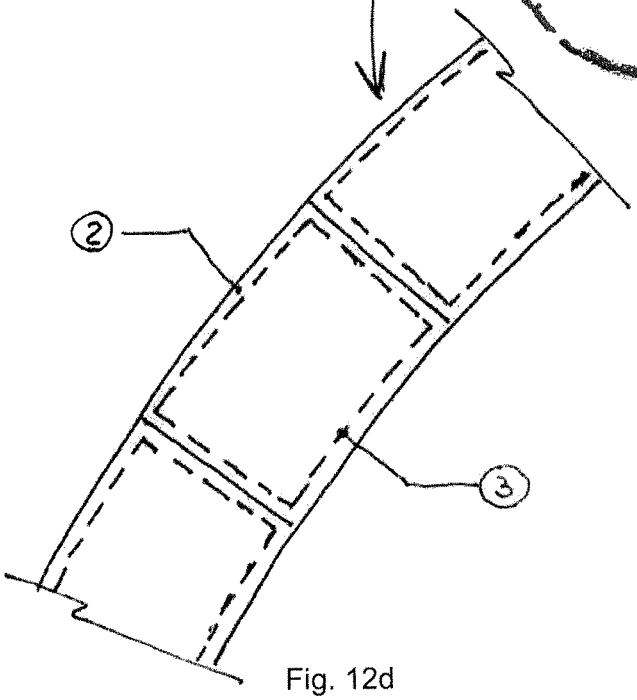
Fig. 12d Fig. 14a
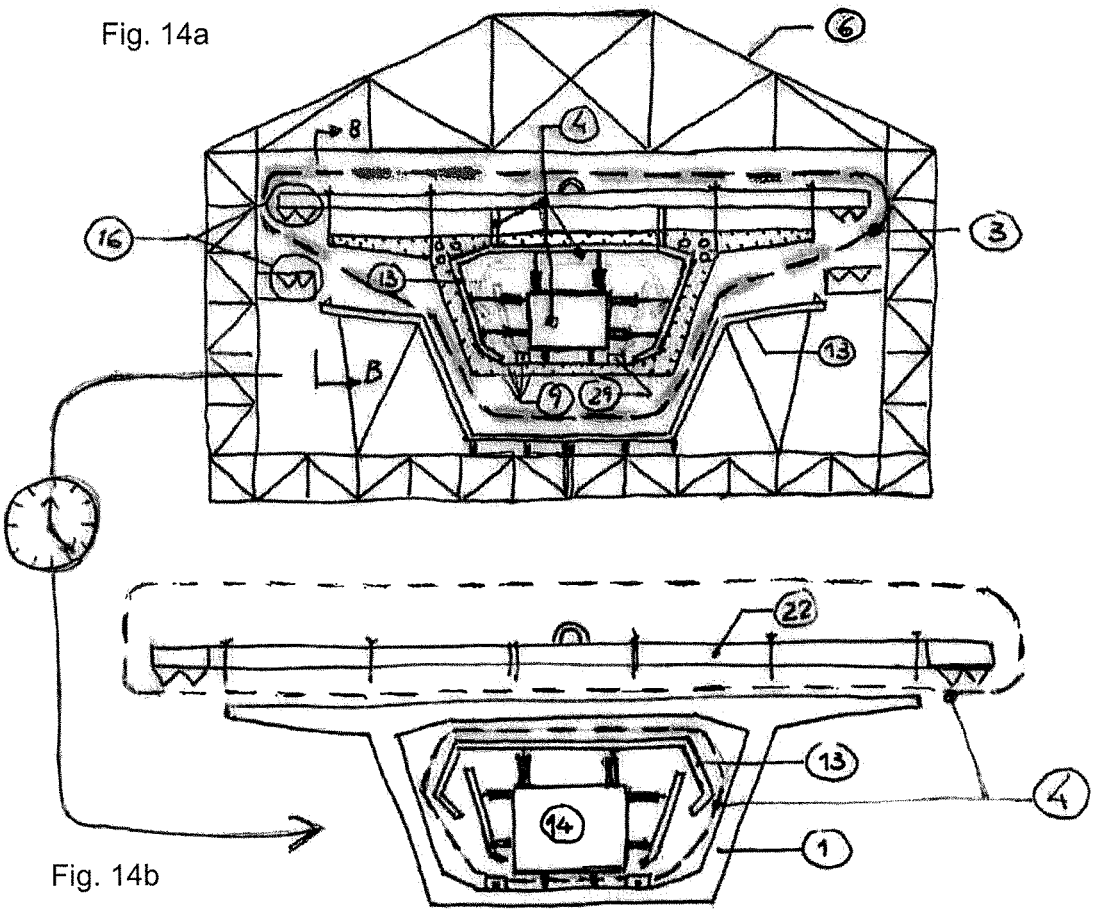
Fig. 14b
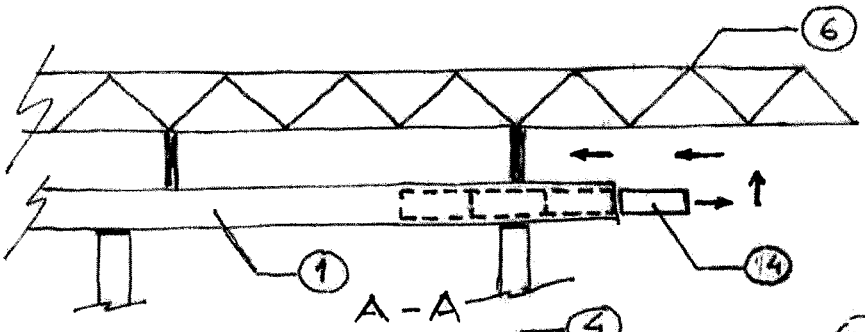
Fig. 14c
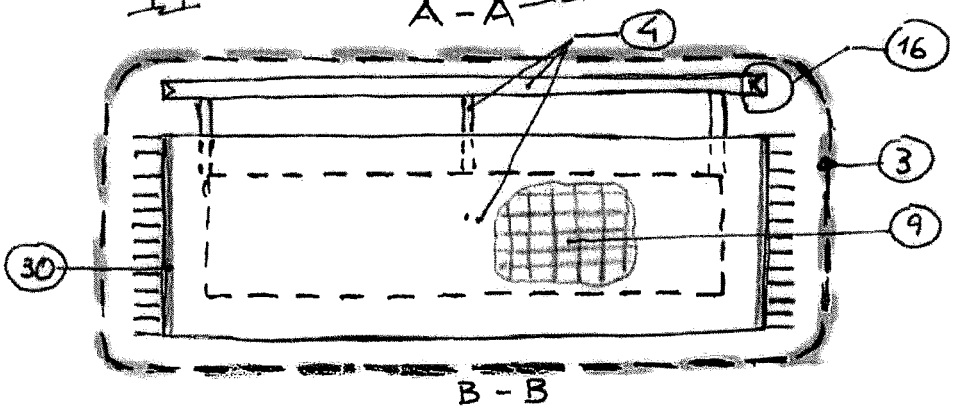
Fig. 14d

Fig. 15d A - A

Fig. 19a
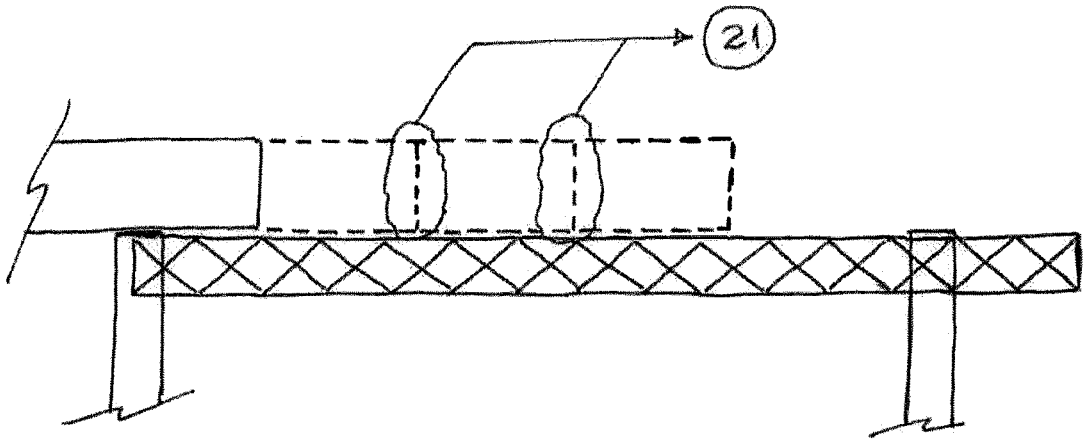
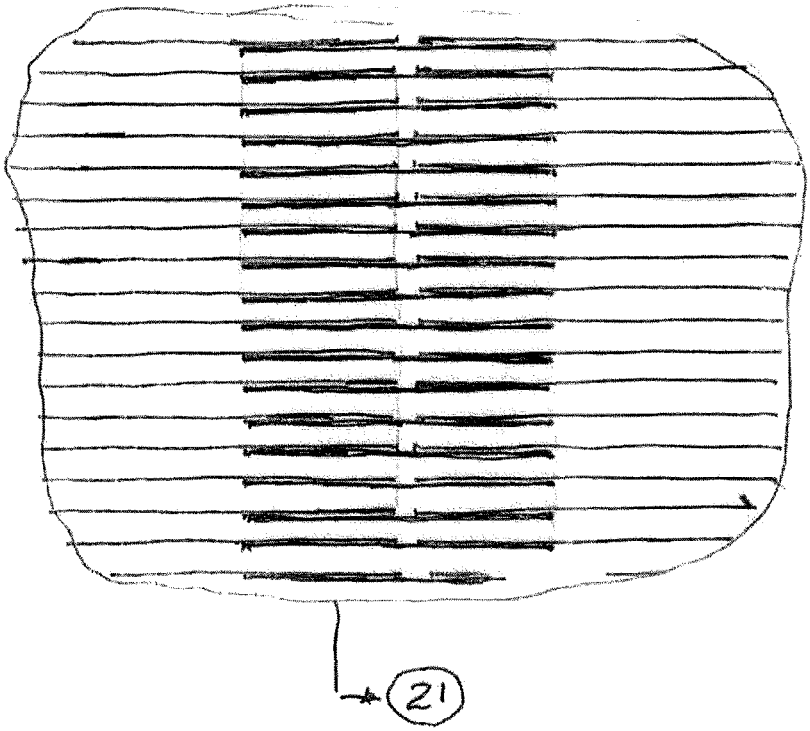
Fig. 19b

Fig. 20a
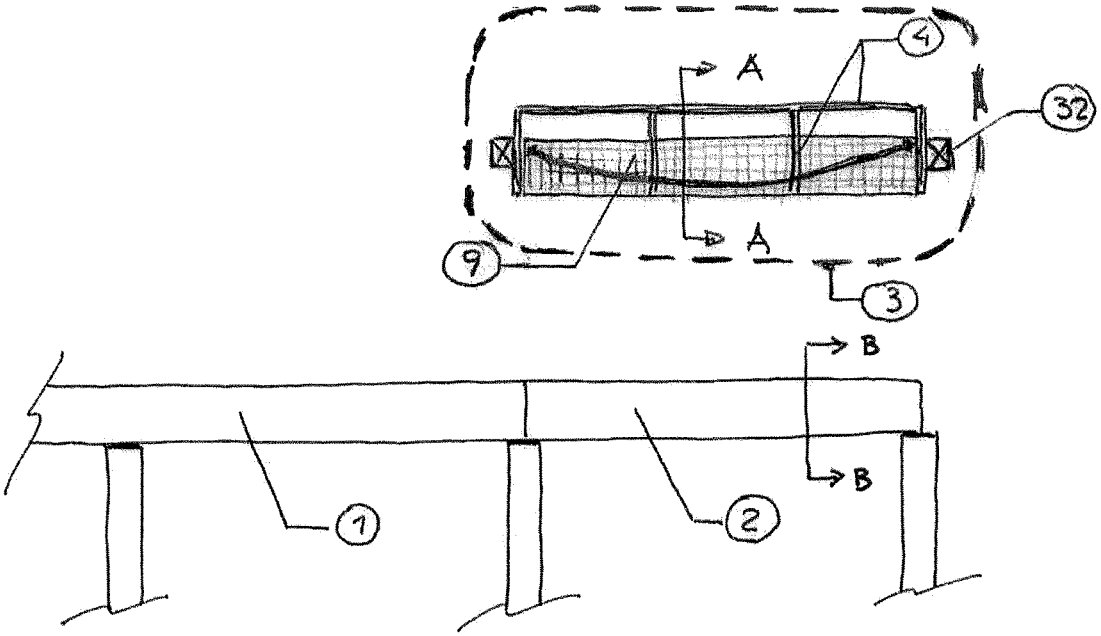
Fig. 20b
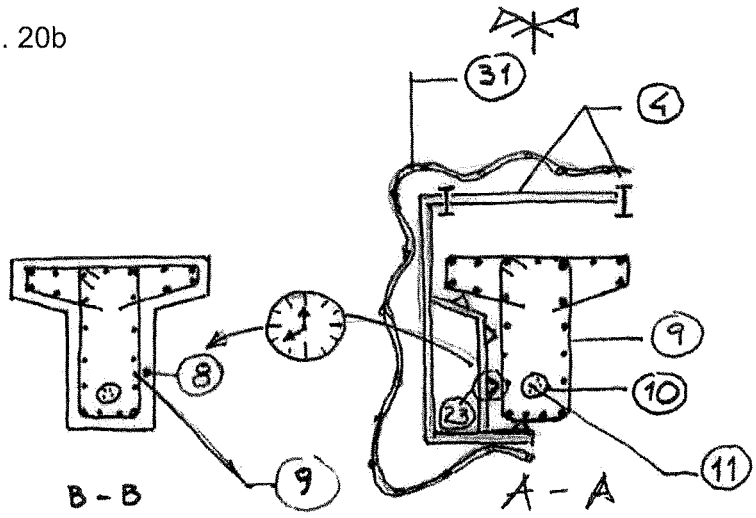
Fig. 20c

CONSTRUCTION PROCESS OF STRUCTURES WITH EMPTY SEGMENTS AND CONSTRUCTION SYSTEM OF STRUCTURES WITH EMPTY SEGMENTS

SCOPE OF THE INVENTION

The present invention relates to a construction process of structures in situ, with or without prestressing, in particular, bridge decks, with a high component of ex situ prefabrication, including the assembling of empty segments, which precedes the activities in situ.

The present invention further relates to a construction system of structures comprising empty segments.

BACKGROUND OF THE INVENTION

There are several documents on the prior art concerning the industrialization of building structures, including prefabrication and optimization of construction processes.

Document U.S. Pat. No. 3,299,191A discloses a method for sequential construction of works with many spans. Document U.S. Pat. No. 3,367,074 discloses a method for constructing prefabricated bridges. Documents U.S. Pat. Nos. 4,073,115 and 3,989,218A reveal methods to strengthen the construction by successive advances.

Documents DE-B-1101477 and GB2073296A disclose systems for controlling or reducing deformations of structures made in situ, and document PTE1639203 presents a system for constructing structures in situ.

Several prior art elements can also be found in Puentes I, II, III, by Javier Manterola, *Prestressed Concrete Bridges*, by Christian Menn, or *Construction and design of prestressed concrete segmental bridges*, by Jean Muller and Walter Poldony, among others.

In the methods of building structures with in situ concreting, in order to increase the industrialization of the process, it is possible to observe the partial pre-assembling of the steel reinforcement before being placed on the formwork as this process has been in common use for many years. However, in this process, the operations of assembling the steel reinforcement are not comprehensive and do not ensure the exact final geometry of the prefabricated elements. This last aspect is of great importance because it means that after placing portions of reinforcement elements (steel reinforcements) in the final position in the structure to be constructed, it is still necessary to reposition these steel reinforcements in the final position and mount the respective moulds; these activities have an important impact on the production cycles.

Additionally, the transport and handling of these pre-assembled steel reinforcement systems become increasingly complex with the increase in size of the prefabricated modules and, therefore, there are functional limitations to pre-assembled steel reinforcement systems of great size, or to pre-assembled steel reinforcement systems that include, for example, horizontal elements of some size. The prefabrication of pre-assembled steel reinforcement systems without relevant need for subsequent handling is reduced to elements whose smaller size in the plant view is around a few dozen centimeters.

In short, the in situ concreting processes have the advantages of requiring less means of transport and lifting, less means of support and less logistic means in the facilities and may, in some cases, lead to further optimization of materials, but they are less industrialized and require more manpower at the works front line (sometimes off shore) and could lead to extended construction deadlines. The traditional prefabrication processes are fairly industrialized, with significant reduction of construction deadlines, with more control in construction site fabrication, with a very significant reduction of work at the works front line (sometimes off shore). However, they have some disadvantages, in particular because they require load transport and lifting systems that are very powerful and expensive, as well as requiring additional resources and logistics means at the facilities and not ensuring the perfect continuity between all the structural elements, which may not allow for, in some cases, the most appropriate optimization of the material quantities or, according to some authors, may not ensure the best seismic performance (where this is relevant).

The construction process shown in the present invention may be a solution of high potential, an alternative to the precast segmental construction method, and that minimizes the main limitations or adversities of this method in accordance with the state of the art.

GENERAL DESCRIPTION OF THE INVENTION

The objective of the present invention is to propose an industrialized construction process that provides substantial gains in productivity, minimizing the use of auxiliary equipment in the construction of structures or parts of structures.

This objective is accomplished by means of an industrialized construction process.

In particular, the construction process according to the present invention proposes to carry out all activity of prefabrication of construction elements ex situ, henceforth referred in the present document as empty segments, except the filling thereof, which is carried out in situ, without moving and transporting heavy loads, which is applicable to structures of various scales including smaller-sized structures and large structures.

In particular, the objective of the present invention is attained through a construction methodology or process that provides the prefabrication of the said empty segments—consisting of fixing elements and steel reinforcement elements and adapted to receive the filling material—allowing a process which simultaneously ensures a high degree of industrialization—ensuring tight deadlines and optimizing manpower at the works front line (similar to prefabrication construction) but without the need for heavy means for moving, lifting and transporting loads—reducing facilities requirements and logistic means—and, at the same time, ensuring the continuity of the structural elements, through the in situ application of the filling material, allowing an adequate level of material optimization.

The construction process of a so-called reference segment (corresponding to a construction segment of the structure or part of structure, to be constructed) is established in a systematic way and consists of the following steps:

- prefabrication ex situ of said empty segments;
- transport of said empty segments from the mentioned ex situ place to the in situ place;
- placement in situ of these empty segments in a final placement position corresponding to the respective reference segment;
- Filling in situ of these empty segments with filling material without discontinuity of said filling material in existing interface areas between any two contiguous reference segments of said structure (absence of these interface areas if there is only one empty segment);

consolidation of the filling material so as to obtain at least part of the structure to be constructed, and removal of the fixing elements and existing moulds and not included therein.

According to preferred embodiments of the present invention, in the case of prestressed structures, there may also, in some cases, occur the placement of the prestressing ducts in the empty segments in situ (and the introduction of cables may be performed in situ or ex situ; in both cases the respective tensioning occurs in situ, after filling and consolidation of the filling material (post-tensioning solutions).

However, the proposed construction process according to the present invention allows both post-tensioning and pre-tensioning methods, and in the latter case, the process provides that the said step of prefabrication ex situ of said empty segments also includes the steps for introduction of the prestressing cables and the tensioning of these prestressing cables. It further includes the in situ step of transmitting the pre-tensioning of said fixing elements for the filling material.

It should be noted that, in these applications with prestressing, the goal is maintained for the most time consuming tasks to be performed ex situ and without moving and transporting heavy loads.

Another objective of this invention is to provide a construction system that supports the execution of an industrialized construction process of structures or parts of structure with substantial gains in productivity and a reduction in auxiliary means of construction.

Indeed, the construction process according to the present invention presupposes the existence of a construction system that features at least one empty segment provided with a general geometry corresponding to that of a respective reference segment and adapted so that it can be prefabricated and in order to receive the appropriate filling material. Said empty segments comprise at least steel reinforcement elements and fixing elements, the latter including at least a system of rigid elements and part of the moulds, and said fixing elements are designed to ensure the geometry and stability of said empty segments during transport and placement, and to ensure compatibility with the moulds that are not included in these fixing elements. Said system of rigid elements should at least have the structural capacity to support itself and to support the steel reinforcements and the moulds included in the fixing elements.

The resolution of the problem presented, and in particular the viability of said empty segments, requires the integration therein of a preponderant element: the hereinafter called 'fixing element', consisting of rigid elements and including at least part of the moulds, which generally provide the geometry and stability to the empty segments from their prefabrication to their placement in the final position in the structure, or part of structure, to be constructed, where the filling of the empty segments occurs, and these fixing elements are removed at the end of each cycle for reuse (if applicable). These fixing elements should also be compatible with the moulds needed for the construction of the structure that are not included therein.

Said fixing elements must have, at least, three properties:

the capacity to ensure stability of the empty segments during transport and placement—the rigid elements and mechanically adjustable elements eventually included should be dimensioned to withstand the weight of the steel reinforcement elements and the moulds included in the fixing element and also their own weight. That is, the said system of rigid elements must have, at least, structural capacity to withstand itself and support the steel reinforcements and the moulds included in the fixing elements. This structural dimensioning must ensure not only the adequate resistance of the fixing elements but must also ensure that the deformations are compatible with the operational requirements of the various components, in particular the tolerances and other geometric and/or kinematic requirements;

the capacity to ensure the geometry of the empty segments during their transport and placement—whereby the fixing elements allow the positioning of the steel reinforcement elements and moulds, after correct ex situ assembling—retain their correct position in the empty segment, and devices that are known in the state of the art can be used (for example, spacers, positioners) to position the steel reinforcement elements over or under the rigid elements and/or moulds of the fixing elements. Additionally, the mechanically adjustable elements allow for fine-tuning during the placement of the empty segments, if necessary;

finally, the fixing elements should be designed in a manner consistent with the moulds that are not included in them (if any) so that it is possible to assemble and disassemble these moulds, being that, depending on the adopted solution, their assembly may occur at a stage earlier or later to the placement of the empty segments;

It should be noted that the fixing systems, due to the previously mentioned structural capacity, allow the process to be applied to a wide range of scales, and can be applied to structures that have sections with widths of only dozens of centimeters to structures that have sections of dozens of meters.

With regard to the optional features of the fixing elements, which is a relevant part of the object of claim 15, each fixing element may be a retractable structure, may include a system of mechanically adjustable elements, may include mechanical devices to change position, may include gripping devices, may include sliding devices, may include fixing interfaces (which should be designed in a manner compatible with the corresponding interfaces of other elements, for example, in shoring systems or in the moulds outside the fixing elements), may be a separable parts system (comprising, for example, a rigid structure that supports the moulds and steel reinforcement elements), may be a system that includes insulating devices to trespass the filling material (without connection to concrete) and may be a system that includes concrete accelerating systems, for example, concrete accelerating systems by steam. These optional features can be combined in various ways in view of the construction characteristics and other existing equipment, for example shoring systems or moulds.

According to a preferred embodiment of the present invention, the said fixing elements, or one fixing element, may also optionally and depending on the design of the structure, or part of a structure, to be constructed, and the construction system, be provided so as to present an autonomous and sufficient structural capacity, and optionally configured so that they can support the load of the filling material, to ensure the stability of the said empty segment during the filling thereof with a filling material or may be provided so that they present a structural capacity to be pre-tensioned, including the capacity to sustain the pre-tensioning action of the cables, and wherein the said fixing element includes rigid reaction devices for tensioning so as to provide reaction in the said tensioning.

There are preferred embodiments that maximize the advantages resulting from the application of the proposed construction process and system, in particular the possibility to, in the prefabrication of the empty segments, include the assembling of interface elements and/or inserts, including profiles of metallic material, and/or carbon fibers, or prefabricated anchoring blocks or other prefabricated elements or elements to position the steel reinforcement, or elements to perform negatives in the filling material or a combination of, at least, part of the above elements, or include in that prefabrication the assembling of seals or other interface elements between moulds. It should also be possible to do variations of the process presented comprising additional activities in situ of placement of reinforcement elements or of placement of additional elements of moulds.

According to another preferred embodiment, the industrialized nature of the proposed process and construction system is greatly enhanced if the system is repetitive so as to include additional steps: in situ removal of fixing elements and, at least, part of the said moulds, transportation of the said fixing elements to ex situ prefabrication area, and beginning of the next cycle, which may justify the ex situ assembling of a plurality of sets of fixing elements in order to allow more than one front of empty segments prefabrication.

According to a preferred embodiment, according to claim 13, the construction process can be adopted in a hybrid manner, combining the proposed process and system with conventional construction methods, for example with in situ conventional construction or with prefabricated conventional construction. In other words, it is possible to carry out construction of, at least, part of the structure to be constructed with use of said empty segments and another part of the said structure to be executed, at least, partly simultaneously through the use of structure segments entirely prefabricated ex situ (that is, in accordance with a prefabrication process according to the state of the art) with correspondence to reference segments and/or special pier segments entirely prefabricated ex situ without the use of said empty segments and/or simultaneously, or alternatively, the proposed process occurring partly simultaneously with in situ construction of at least part of the structure without the use of the said empty segments (conventional construction in situ).

Very important is also the possibility of, in particular in the case of prestressed structures, the process enabling the full assembling of steel reinforcement elements in the empty segments, prefabricated ex situ, without any need of activities with steel reinforcement elements in situ. And, if there is more than one empty segment, this implies the inclusion of the previous step of structure design which includes checking the limit states and use in the existing interface sections between any two adjacent reference segments and that are not trespassed by steel reinforcement elements.

This preferred embodiment, is particularly useful for the construction of structures, such as bridge decks in prestressed concrete, and can enable faster production cycles than the prefabricated construction according to the state of the art, to the extent that the placement of the empty segments is faster than the placement of prefabricated segments with filling material already incorporated (prefabrication according to the state of the art).

Indeed, and as will be developed below, depending on design options used in the construction process in accordance with the present invention, the way of designing the structure to be built may be different from the current methods to design structures in situ and current methods to design prefabricated structures, due to the mechanical conditions of the interface sections between adjacent segments, in the final structure executed being different from those resulting from methods according to the state of the art.

The construction process and system according to the present invention can be applied to different types of structures, with different sections and with different materials, in particular presenting a construction system that includes one or more structures with a box girder section, a rectangular section, a square section, a Pi section, a T section, a double T section, a circular section, a triangular section, or any other form of mechanically feasible section for executing the said structure, including one or more structures which are, at least, a part of a bridge deck or overpass, a pier, an arc, a beam, a structural element with vertical walls, an inclined element or a complex structural element with another shape including one or more structures that are comprised of a filling material which can be, for example, a concrete, a hydraulic binder, a glass, a ceramic material, a plastic material, or an alloy.

In the design of a construction process the choice of types of construction equipment is of special relevance, in particular the selection and characteristics of shoring systems, which can be for example, self-launching scaffolding or ground scaffolding. The application of the proposed process and system may be enhanced if in the design or adaptation of the shoring system some solutions are adopted that should be evaluated case by case. In particular, the shoring system must be adapted so that it presents kinematic and geometrical compatibility with the said empty segments, including to ensure the possibility of the said empty segments passing in the support elements of the said shoring system (if applicable) and/or to ensure that the said shoring system or the moulds coupled therein include interface fixing devices to ensure the positioning of the said empty segments that may also have interface fixing devices, and/or that the shoring system features auxiliary means for moving loads to feed the empty segments at the front of the construction depending on the means of transport used in the logistics of the works, and/or shoring system having concrete accelerating system, for example, concrete accelerating system by steam.

It should be noted that the application of the presented process and the system presupposes that the structure to be constructed is configured so that it can be divisible into one or more so-called reference segments, which must have direct correspondence with the said empty segments.

The construction processes and construction system proposed according to the present invention, benefiting from prior art, in particular the method of precast segmental construction, sustain a variant solution of high potential that minimizes the main limitations or adversities of this conventional method.

In a systematic way, the process and the system according to the present invention provide the following advantages:

- very high productivity (similar to prefabrication);
- significant reduction of means for handling, lifting and transport of loads in relation to prefabrication;
- easy correction of the geometry of the empty segments (critical factor in the construction by conventional prefabrication, in particular in segmental construction);
- less dependence on conditions at the works front line (similar to prefabrication);
- less allocation of off-shore resources (in relation to in situ conventional construction);
- greater Planning reliability (similar to prefabrication);
- continuity of the filling material (similar to the in situ traditional construction);
- there are, at least, 2 work front lines with reduction of downtime (similar to prefabrication);

potential optimization of materials—especially steel reinforcements, due to less conditioning of the construction phase—(similar to the in situ traditional construction);

better quality control in the placement of active and passive steel reinforcements;

the execution of large spans can become highly competitive in case the cost of piers/foundations is high (for example works in water);

reduction of the works logistics platform (more flexible logistics platform) when compare to prefabrication.

It becomes clear that there is room for the development of a new construction process and a new system that allows the combination of the main advantages of the in situ conventional construction processes and conventional prefabrication processes.

DESCRIPTION OF THE FIGURES

The invention will now be explained in greater detail based on preferred embodiments and the Figures that are attached.

The Figures show, in simplified schematic representations:

FIGS. 9*a*-9*e*: three-dimensional scheme, with cutaway views, elevations views and details, of an empty segment (3) with fixing element (4) with part of the moulds (13) and with possible functional devices of the moulds;

FIGS. 11*a*-11*b*: cross-section and elevation views of a horizontal structure (1) to be constructed, with an empty segment (3) which incorporates the fixing element (4) that includes the mould (13);

FIGS. 12*a*-12*d*: cross-section and elevation views of vertical or inclined structures (1) to be constructed, with an empty segment (3) which incorporates the fixing element (4) that includes the mould (13);

FIGS. 14*a*-14*d*: two cross-sections and two side views of an empty segment (3) with retractable fixing elements (4) with inclusion of the inner part of the moulds (13) and possible solutions of mould interfaces (13) and additional devices, namely seals (30);

FIGS. 15*a*-15*d*: prefabrication area (5) and prefabrication sequence of empty segments (3) including the fixing elements (4) making use of auxiliary means (7), means of transport (17) of the empty segments (3) and works front line with the structure (1) to be constructed whose cross-section is shown in cutaway A-A, divided by sections to be executed by phases separated by the construction joints (18), the empty segments being represented (3) in the final position corresponding to the counterpart reference segments (2) and also showing the shoring system (6) where the empty segments are positioned (3);

FIGS. 19*a*-19*b*: overlap or overlaps passive elements (21) placed in situ between empty segments (3) in the final position thereof;

FIGS. 20*a*-20*c*: empty segments (3) that include fixing elements (4) that include steel reinforcement spacing elements (23) and concrete accelerating system, for example, by steam (31);

DESCRIPTION OF PREFERRED EMBODIMENTS OF THE INVENTION

The present invention relates to a new construction process and a construction system of structural elements, for example, reinforced concrete, with several configurations, as shown in FIGS. 1, 2, 3, 4, 5, 6 and 7, in which the structures (1) or parts of structures (1) to be constructed are divisible into one or more so-called reference segments (2). The proposed methodology entails a major component of prefabrication, but in which the basic structural material—filling material (8)—which can be concrete, for example, is poured in situ. For the purposes of this description of preferred methods of execution, this will be made with reference primarily to the construction process and thereby including the reference to the main elements of the associated construction system, as perceived by someone skilled in the art.

In order to understand better, the reference segments (2) may coincide in terms of form and constitution with the conventional prefabricated concrete elements and may be segments that cover the span (corresponding to prefabricated beams) or segments with integral cross-section (corresponding to prefabricated segments), or to integral segments (corresponding to complete prefabricated segments), or segments of prefabricated piers, segments of other prefabricated elements, such as curved elements, sloped elements, concrete cores, etc.

Figure 7:
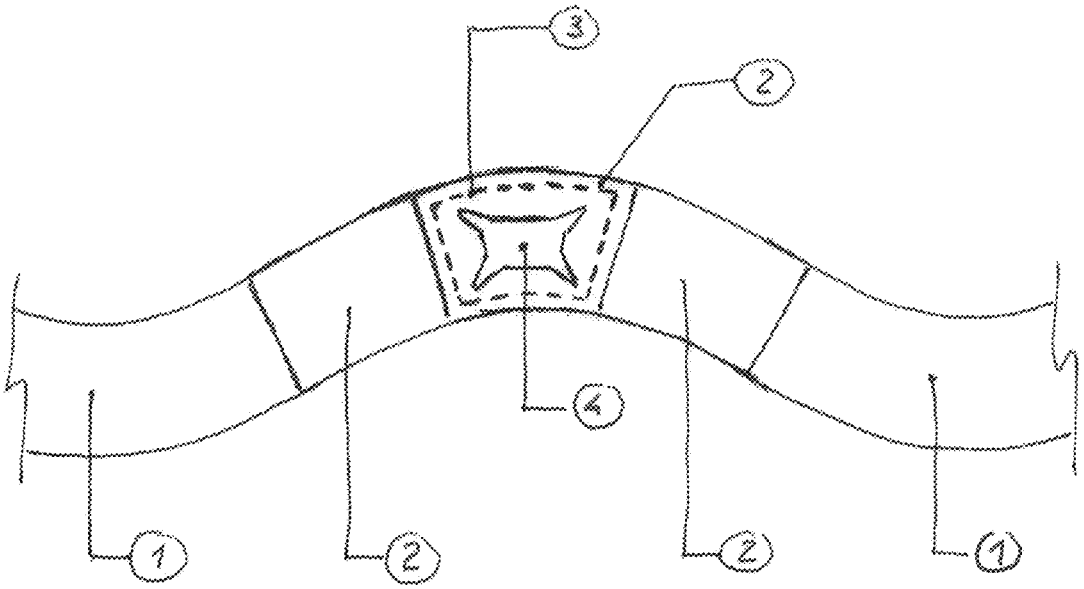
FIG. 7: general structure (1) to be constructed, including identification of possible reference segments (2) and empty segments (3) with total length of span.
Figure 8:
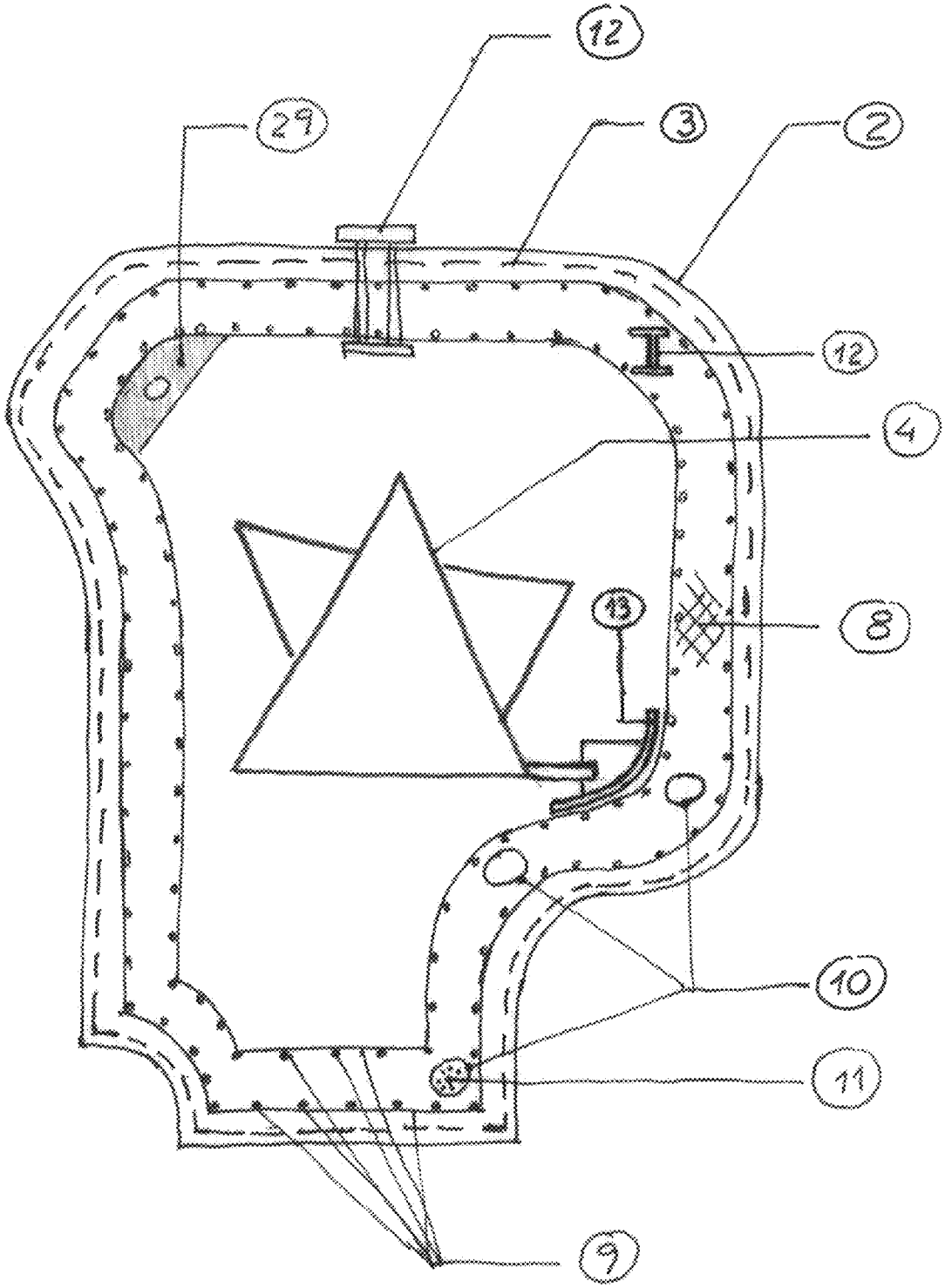
FIG. 8: cross-section of a structure to be constructed coincident with the cross-section of the reference segment (2) with a general configuration and identification of empty segments (3); symbolically represented fixing elements (4); filling material (8); steel reinforcements (9); any active steel reinforcement ducts (10) and respective steel reinforcements (11) and any inserts (12), moulds (13) and prefabricated anchoring blocks (29)
Figure 10A:
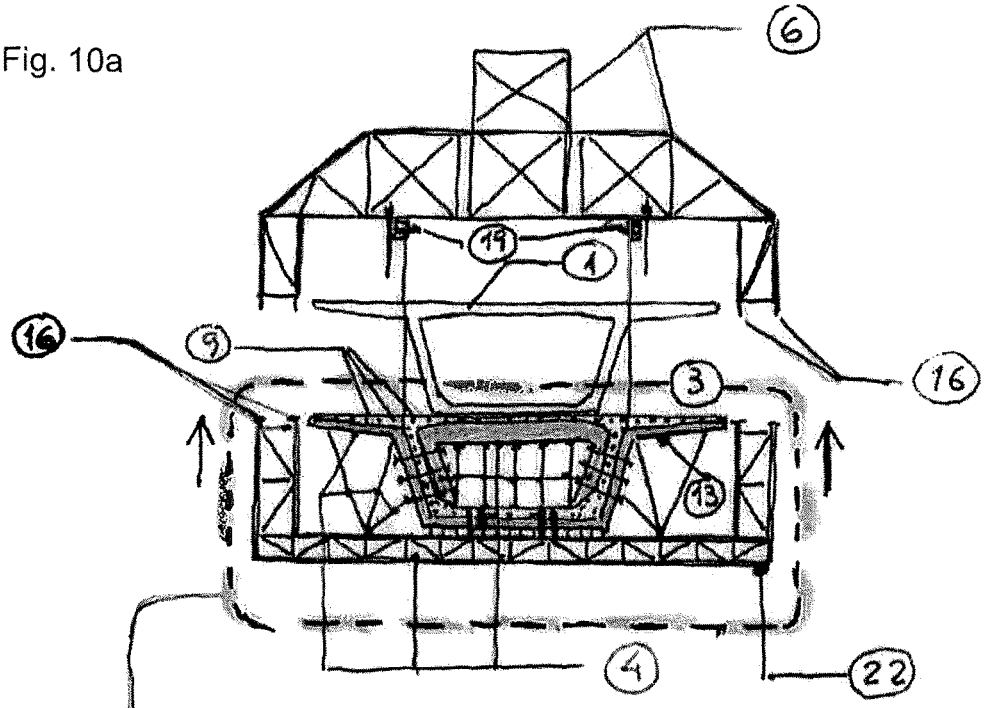
FIGS. 10*a*-10*b*: cross-section of a work with empty segments (3) incorporating fixing elements (4) that include all the moulds (13)
Figure 10B:
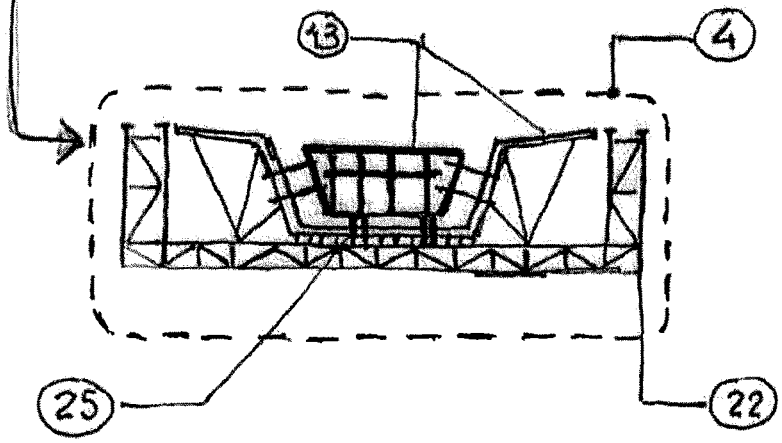
Figure 13A:
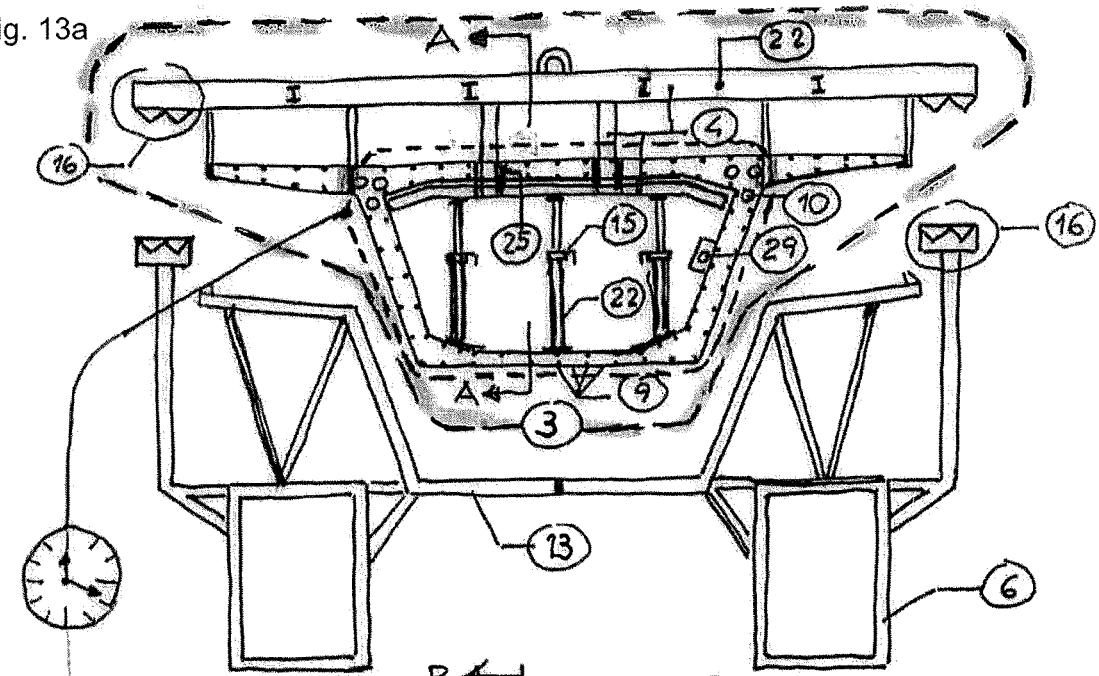
FIGS. 13*a*-13*d*: two cross-sections and two longitudinal sections of an empty segment (3) with fixing elements (4) with partial inclusion of moulds (13) and possible solutions of mould interfaces (13) and additional devices.
Figure 13B:
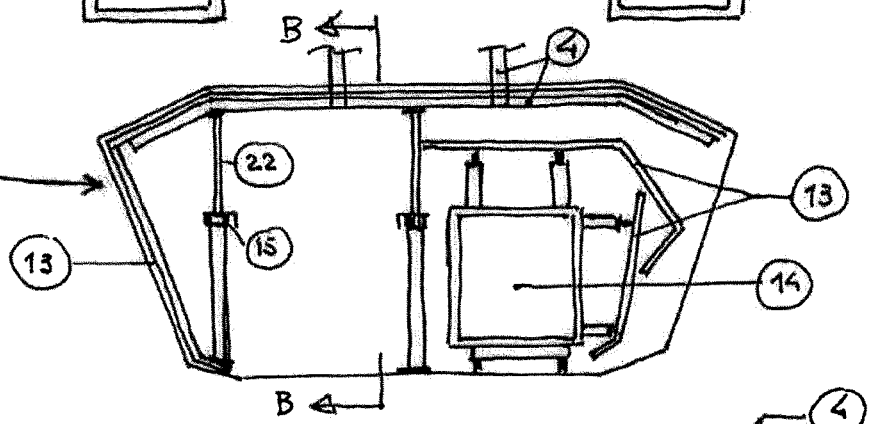
Figure 13C:
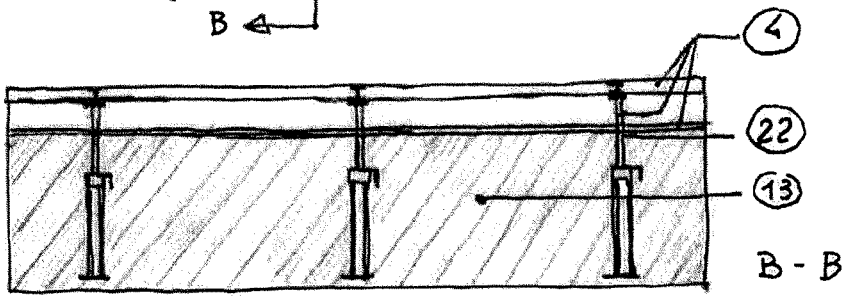
Figure 13D:
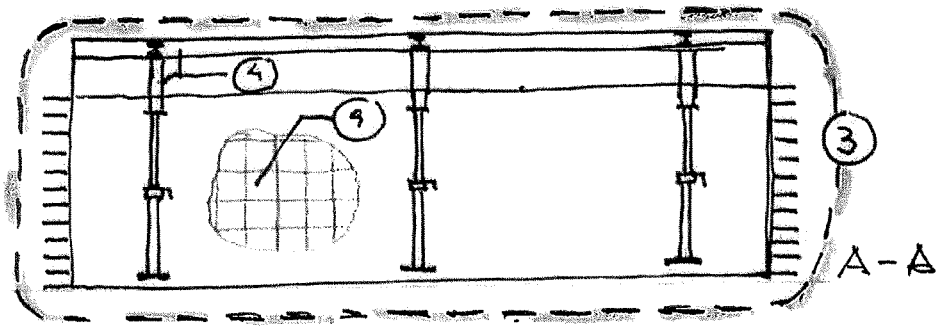

Analyzing FIGS. 7 and 8, the structure (1) to be constructed, and which may have any configuration, is divided into one or more reference segments (2), which may have any configuration. The empty segments (3) have direct correspondence with the reference segments (2) regarding the same final position (counterparts). Each empty segment (3) is placed on the structure (1) in the position of the corresponding reference segment (2) having a fixing element incorporated (4) which ensures the geometry and stability of the empty segment (3) during transport and placement, until the consolidation of the filling material (8) (for example, concrete) that is poured into the empty segment (3). The empty segments (3) have, therefore, direct correspondence with the reference segments (2), but do not yet have the filling material (8).

Analyzing FIG. 8, in which the structure (1) to be constructed is seen as a cutaway view and coinciding, therefore, in that section, with the reference segment (2), the empty segment (3) consists of part or all of the elements that make up the reference segment (2), except for the filling material (8). The geometry and stability of the empty segment (3) in the manufacture, transport and installation, is ensured by the fixing element (4) shown symbolically in FIG. 8.

In the case of, for example, reinforced concrete structures, the empty segment (3) comprises passive steel reinforcements (9) already with the final geometric configuration.

In the case of structures (1) of, for example, prestressed reinforced concrete, the empty segments (3) include prestressing ducts (10) and the prestressing cables (11) can be introduced after the assembling of one set of empty segments (3) that are concreted in one same operation, for example, corresponding to a span in the case of a bridge deck. The cables can be fully placed if their length is equal to or less than the empty segment (3).

If the structure (1) is composite or has interface elements or inserts incorporated (12) (for example, metallic elements) that become incorporated in the filling material (8), these elements can also be incorporated in the empty segments (3).

By means of the operation of pouring the filling material (8), and after consolidation of the filling material, the empty segment (3) becomes, therefore, the reference segment (2). In the case of structures (1) of reinforced concrete, this pouring operation is the concreting operation.

Figure 1:
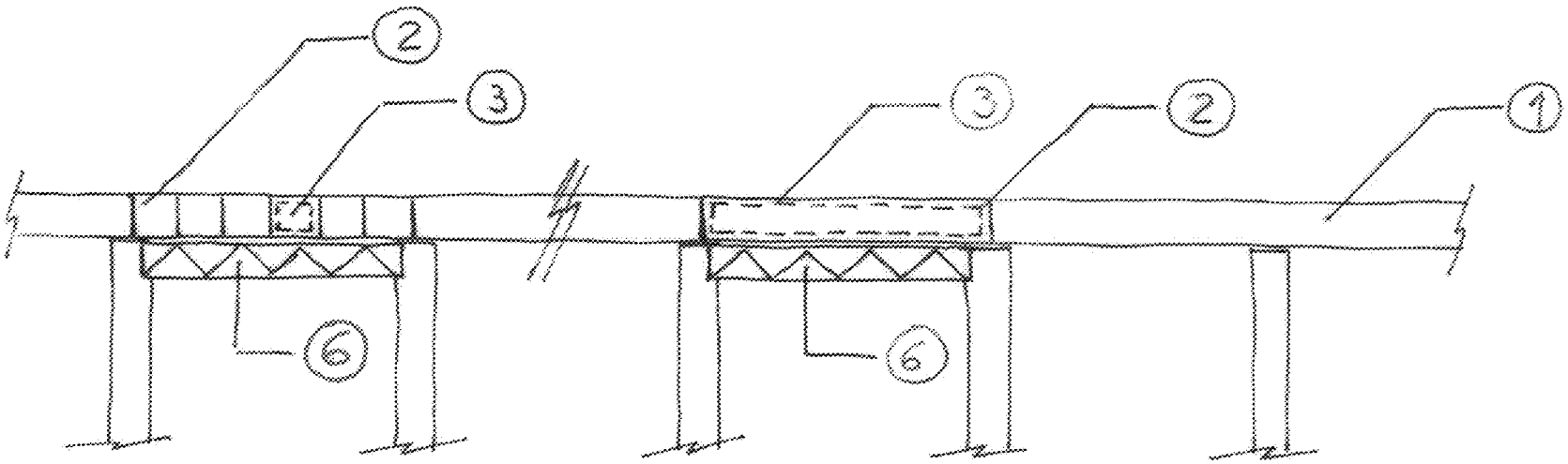
FIG. 1: structure (1) to be constructed of a bridge deck or overpass, including identification of possible reference segments (2) and empty segments (3)

With reference to FIG. 1, the construction process in accordance with the invention can, for example, be applied to the construction of structures (1) like bridge decks, dividing each span into several reference segments (2), or just one reference segment (2), and in this kind of application, use shoring systems (6), such as ground scaffolding or self-launching scaffolding that will sustain the said empty segments (3) until the filling material (8) is consolidated, in case the fixing element (4) does not have resistant capacity to cover the span in question.

Figure 6:
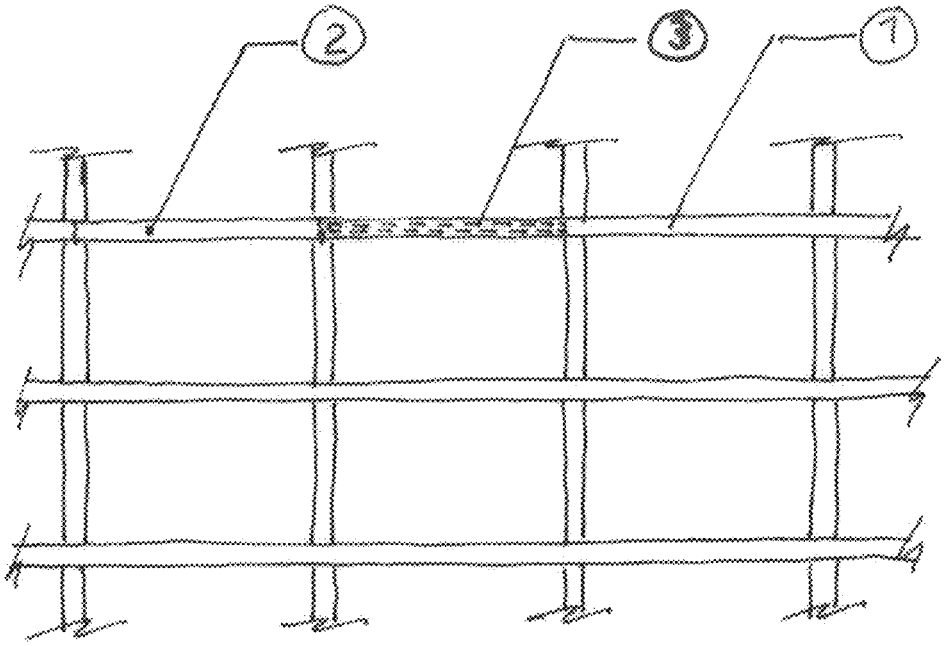
FIG. 6: structure (1) to be constructed in a multi-story frame, including identification of possible reference segments (2) and empty segments (3)

If the fixing element (4) is dimensioned to have structural capacity to support the filling material (8), then the empty segment (3) can be placed without the use of shoring systems (6), as shown schematically in FIGS. 6 and 11.

With reference to FIGS. 4, 12*a*, 12*b*, 12*c* and 12*d*, in the case of construction of structures (1) of the vertical elements type, for example, it is also not necessary to use shoring systems (6), and the empty segments (3) can have interfaces (16) to fit directly into reference segments (2) previously executed, or into empty segments (3) previously placed.

An important aspect in the application of the construction process in accordance with the present invention is the fixing element design (4). This element must comply with three requirements: i) ensure the final geometry, or close to the final one, of the elements that make up the empty segment (3) so that, by means of quick and simple operations, it is easy to ensure the desired geometry for the empty segment (3) after it is placed; ii) have the structural capacity to ensure the empty segment stability (3) in its transport and placement; and (iii) be compatible with the moulds (13) of the element to be constructed that are not included in the fixing element (4), or including those same moulds (13).

Additionally, it may also be advantageous, for the fixing element (4) to be previously prepared so as to be easily positioned, for example including fixing devices (16) that can be both positioners and fixing devices (16), or other devices which ensure the correct positioning of the empty segment (3).

In FIGS. 9*a*, 9*b*, 9*c*, 9*d*, 9*e*, 10*a*, 10*b*, 11*a*, 11*b*, and 121, 12*b*, 12*c*, 12*d*, 13*a*, 13*b*, 13*c*, 13*d*, 14*a*, 14*b*, 14*c*, and 14*d*, there are some examples of drawings showing fixing elements (4). Other designs can be developed resulting from combinations or their adaptation to each case.

The fixing elements (4) may, for example, include all the moulds from the outset (13), for example the formwork, as in the cases of FIGS. 10, 11 and 12. But they may also, for example, include only part of the moulds (13), as in the example of FIG. 9, or include intermediate solutions in which the fixing elements (4) comprise individual or localized areas of moulds, as is the case of FIGS. 13*a*, 13*b*, 13*c*, and 13*d*.

The fixing elements (4) include rigid elements (22) and may include, for example, adjusting devices (15) which may be useful not only to adjust the final geometry of the empty segment (3) but may also be useful to facilitate the removal of the fixing elements (4) after the empty segment (3) is filled by the material (8) and this is properly consolidated, or even to move or lift part or all of the fixing elements (4).

The adjusting elements (15) may consist of mechanical elements for manual adjustment, for example mechanical spindles, or other mechanical elements known in the state of the art, such as hydraulic jacks, manual spindles, retractable elements, or others with similar functions.

In FIGS. 14*a*, 14*b*, 14*c*, and 14*d*, there is an example of retractable fixing element (4) incorporating the inner moulds (13) of the structure. This type of solution to increase productivity can, for example, require doubling or tripling, or another number of fixing elements (4) for each position of the structure to be constructed, i.e. corresponding to each reference segment (2).

Example of Application of the Invention

Next, and only by way of example, follows an explanation of the application of the construction process in accordance with the present invention to the construction of prestressed box girder decks concreted in situ using, for example, a shoring system (6) which is self-launching scaffolding. The necessary adjustments for the application of this process to other types of structures are explained later on.

This construction process, when applied to this example, comprises seven stages:

A. Prefabrication of empty segments (3), including assembling of fixing elements (4) in an ex situ prefabrication area (5);

B. Transport and placement of the empty segments (3) in the scaffolding (6);

C. Concreting of the structural element (1);

D. Curing period;

E. Prestressing of the structure (if any) and removal of scaffolding;

F. Removal of the fixing elements (4) and transport to prefabrication area (5).

With reference to FIGS. 15*a*, 15*b*, 15*c* and 15*d*, the L1 portion of structure (1) to be constructed in a cycle, limited by two construction joints (18) may have, for example, a dimension equal to that of the L span, corresponding to the spacing of the piers, but may have other dimensions, for example, 2×L among others.

It is possible that, for example, the deck (1), with a box girder cross-section indicated in cutaway A-A, for example, can be executed with several reference segments (2) per span. Each reference segment (2) to be constructed corresponds to an empty segment (3).

Figure 15A:
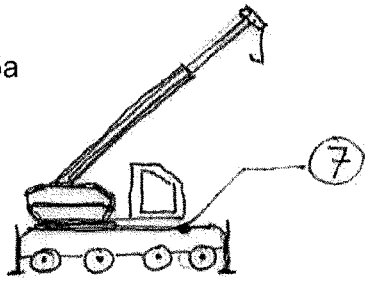
Figure 15A:
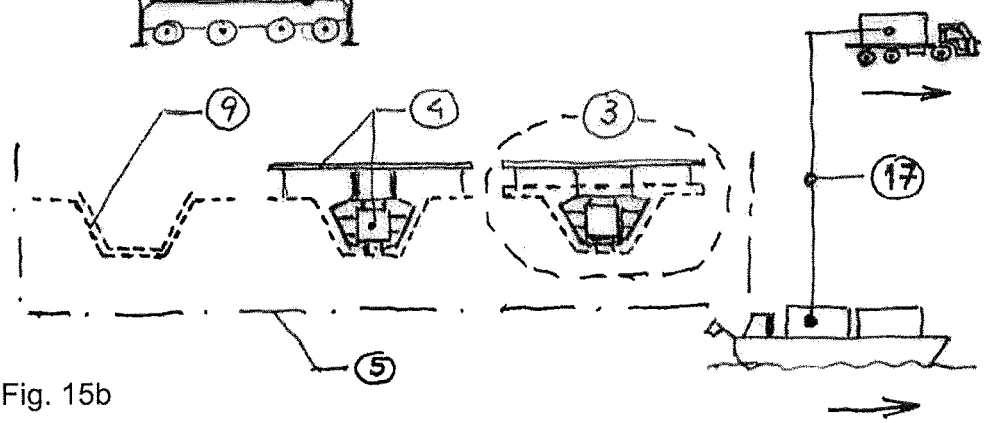
Figure 15B:
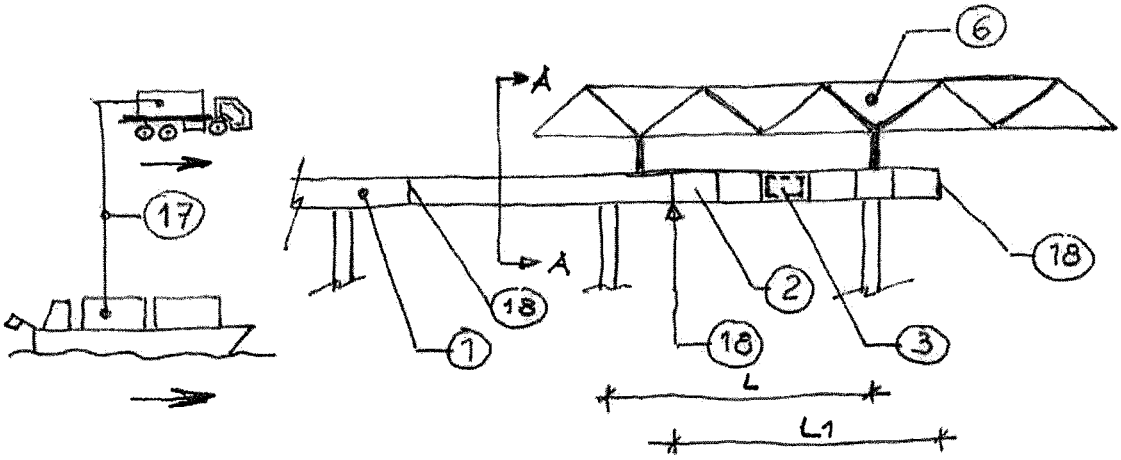
Figure 15C:
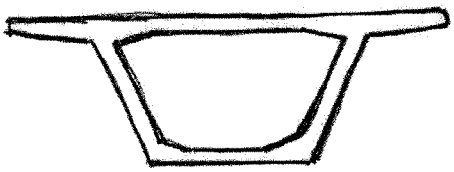

With reference to FIG. 15*c*, it is possible to use overhead self-launching scaffolding (6) (other types of scaffolding can be used, for example, lower scaffolding, ground scaffolding, etc.), with construction joints (18), located, for example, close to ¼ or ⅕ of the span or in another section, and the location of the construction joint (18) may be on the pier, or in another section closer to or away from the pier than indicated, to be defined on a case by case basis.

Phase A—Prefabrication of Empty Segments (3), Including Assembling of Fixing Elements (4) in an Ex Situ Prefabrication Area (5);

This phase is explained based on FIGS. 14*a*, 14*b*, 14*c*, 14*d*, 15*a*, 15*b*, 15*c*, 15*d* and 29.

The fixing elements (4) could, in this example, have the configuration defined in FIGS. 14*a* and 14*b*, but could have other configurations as mentioned before. Therefore, in this example, the fixing elements (14) include the inner moulds (13) (or inner formwork) having adjustment elements (15) in that area to facilitate subsequent adjustment and removal, and include rigid elements (22) to stabilize and ensure geometry of the steel reinforcement (9).

The fixing elements (4) to use in each cycle (except in the first cycle) are from the works front line, where they were used in a previous cycle. A preliminary operation, applicable to this example, consists in cleaning and painting with form release agents, or similar products, the modules, the inner formwork (13) that, in this example, are an integral part of the fixing element (4).

The empty segments (3) are prefabricated by assembling the steel reinforcements (9) in a manner compatible with the assembling of fixing elements (4) that integrate the empty segments (3), and part of the moulds (13) (inner formwork) which in this example is also part of the fixing element (4), and these three activities must be carried out in order to comply with the geometry of the reference segment (2) corresponding to the segment to be executed of the works, i.e. complying with the geometry of the final structure (1).

To increase productivity and quality control, steel reinforcement spacing elements can be used (23) i.e. 'gabarits' for positioning the steel reinforcements, for example, pierced steel sheets with strict position of each rod or cable, pieces of wood, pieces of concrete; in other applications these elements may also be an integral part of the (4) fixing elements, as shown for example, in FIGS. 20*a*, 20*b*, and 20*c*.

There may be an assembly line, for example, as schematically shown in FIG. 15*s*, in which auxiliary means (7) can be used. Several sequences of assembly of empty segments can be implemented (3). All this so that the empty segments (3) are completely prepared to be placed in the next span.

Depending on the structure (1) designed, the empty segments may include prestressing ducts (10), interface structures or inserts (12), or other elements that are part of the final structure (1) that can be incorporated in the prefabrication, as, for example, the prefabricated anchoring blocks (29), prefabricated elements (33) (see FIG. 29), among others.

The empty segments (3) must be made with the same or very similar geometry to that which ensures the correct execution of the final structure (1) and the fixing elements (4) must ensure the stability of the empty segments (3) during transport and placement. The fixing elements must be compatible with the moulds (13), in this case the formwork, which are not included in them, and, as is the case of this example, include the inner formwork (13) as shown in FIGS. 14*a* and 14*b*.

If each empty segment (3) has a sole position for placement in the shoring (6), it may be appropriate to mark the empty segments (3), for example, by numbering them.

The fixing element segments (4) may also be provided with collective safety equipment, e.g. guards, platform, or safety belts fixing elements, which may be useful for carrying out the work safely.

In the case of the fixing elements (4) incorporating elements that trespass the filling material (8), in this case concrete, as it happens, for example, in the fixing element (4) in FIGS. 13*a*, 13*b*, 13*c*, and 13*d*, it may be necessary to use some insulating parts (25) of plastic, for example, which prevent the fixing element (4) from aggregating to the concrete when it consolidates.

In some cases, the empty segments (3) fabrication process can be more productive and with greater quality control, if the assembling of the empty segments (3) is carried out in the prefabrication area (5) on a platform, with an L1 extension, which can hold simultaneously and continuously all the empty segments (3) pertaining to the same execution phase.

Phase B—Transport, Placement and Fixing of the Empty Segments (3) in the Scaffolding (6);

This phase is explained based on FIGS. 14*a*, 14*b*, 14*c*, 14*d*, 15*a*, 15*b*, 15*c*, 15*d*, 16, 17, 18*a*, 18*b*, 18*c*, 18*d*, 18*e* and 21.

According to FIGS. 15*a*-15*d*, after being fabricated, the empty segments (3) are transported to the works front line by means of transport (17) that can be by land or water, as shown schematically in FIGS. 15*a*-18*e*. This operation takes place after the shoring system (6) is properly positioned in view of the current stage of construction.

Note that an empty segment (3) has dimensions and weight suitable for easy transport to the shoring system, for example a scaffolding, and for easy lifting and placement in the scaffolding (these elements may weigh several times less than an element of prefabricated concrete, (i.e. than the corresponding structure segment (1)).

Figure 16:
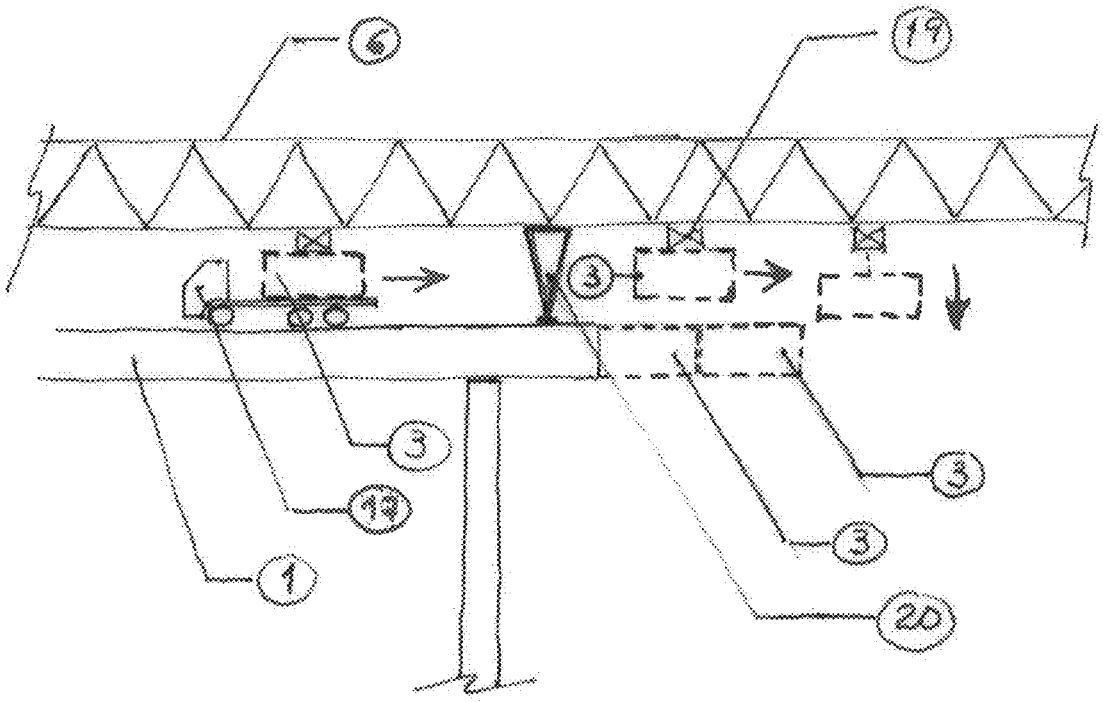
FIG. 16: works front line area including means of land transport (17) of the empty segments (3) and including auxiliary equipment (19) belonging to the shoring system (6) to assist in the handling and placement of the empty segments (3) in the final position on the shoring system (6)
Figure 17:
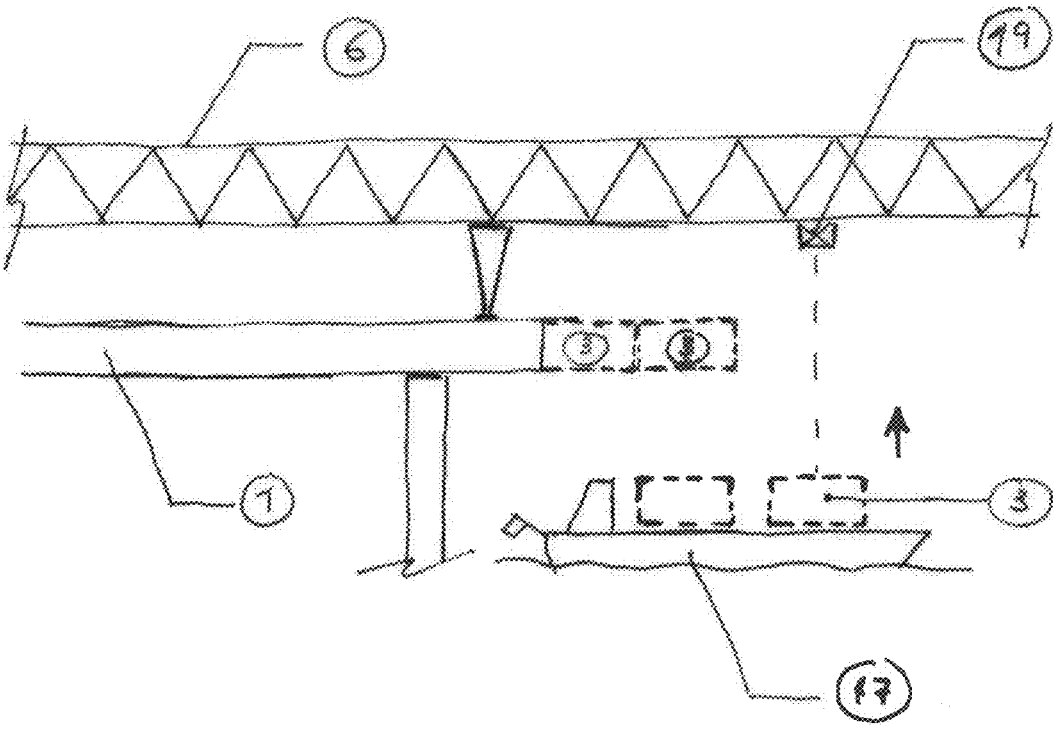
FIG. 17: works at front line area including means of nautical transport (17) of the empty segments (3) and including auxiliary equipment (19) belonging to the shoring system (6) to assist in the handling and placement of the empty segments (3) in the final position under the shoring system (6)
Figure 18A:
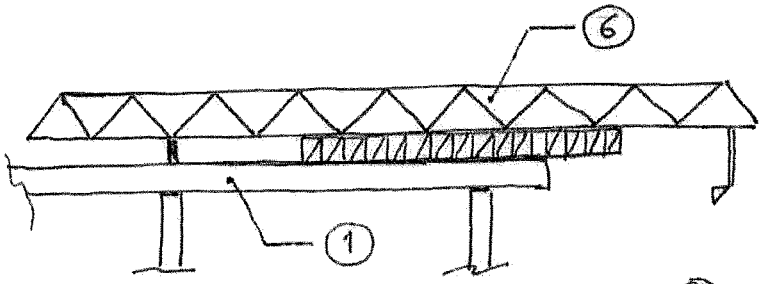
FIGS. 18*a*-18*e*: works front line area including lesser means of land transport (17) of the empty segments (3) and including auxiliary equipment (19) belonging to the shoring system (6) to assist in the handling and placement of the empty segments (3) in the final position on the shoring system (6)
Figure 18B:
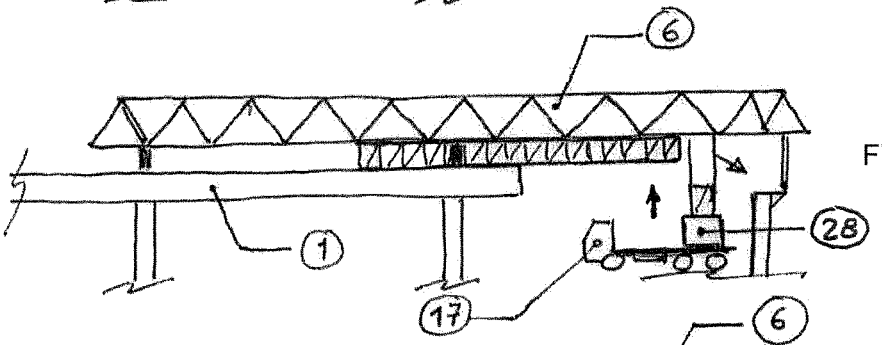
Figure 18C:
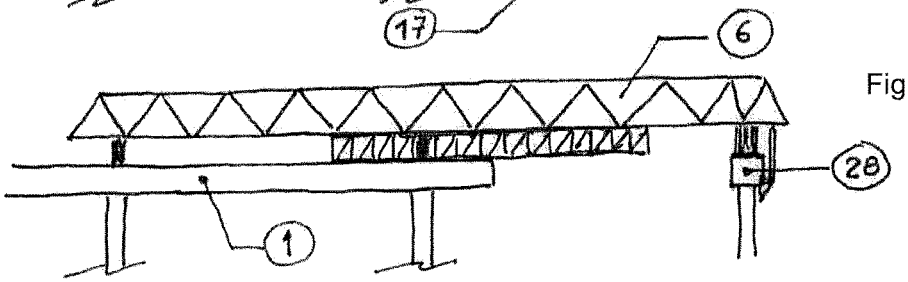
Figure 18D:
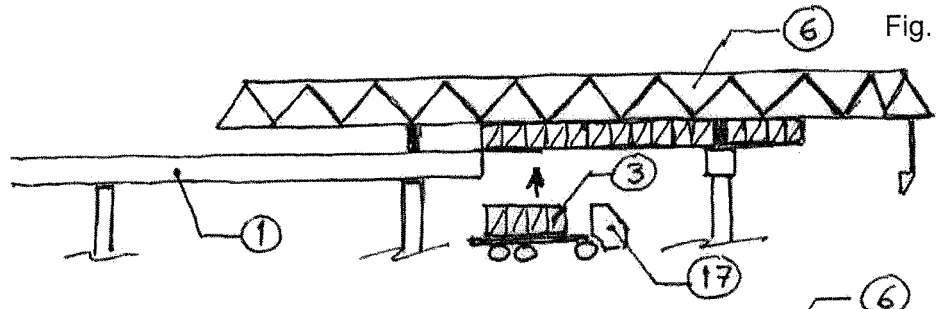
Figure 18E:
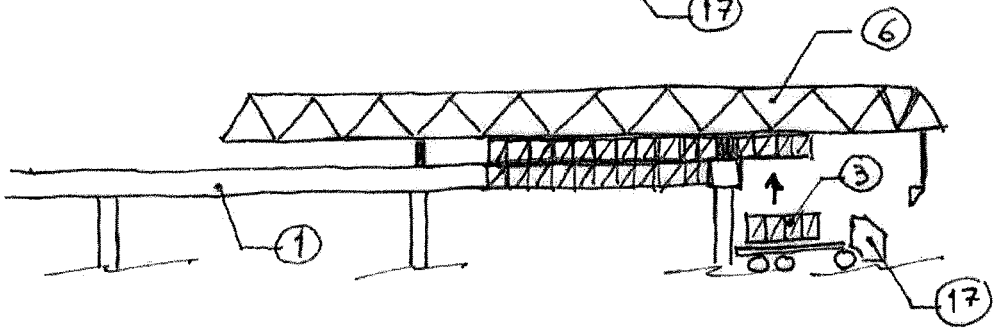

As shown in FIG. 16, the supply of empty segments (3) can be made by means of land transport (17) along the deck, it can be done by lower land means (see FIGS. 18*a*-18*e*), or can be done by lower water means (17), as shown in FIG. 17.

The design of the fixing elements (4) must take account the empty segments (3) type of supply to be carried out in the works. It may be appropriate, for example, to use more complete fixing elements (4), similar to those in FIGS. 10*a* and 10*b* in the case the supply of empty segments (3) is to be carried out bellow the deck.

In the case of using overhead scaffolding (6), the plan view dimensions of the empty segments (3) must be made compatible with the support elements (20) of the scaffolding (6) (shown in FIG. 16). In some cases, it may be advantageous to ensure that the empty segments (3) are introduced as a rotation in the 90° plant view, as it is common in construction with prefabricated segments, and well-known in the state of the art solutions.

The placement of the empty segments (3) in the final position can be made by auxiliary means similar to the auxiliary means (7) of the prefabrication area, or it may be performed by auxiliary means (19) incorporated in the scaffolding (6).

As can be seen in FIG. 14*d*, the existence of interface fixing devices (16) that can ensure a fast and accurate placement of the empty segments (3) can greatly facilitate the operation of positioning and eventual fixing of the empty segments (3) in the final position in scaffolding (6). These interface fixing devices (16) may have several locations, which may be in the scaffolding (6), in the inner or outer moulds (13), in the fixing elements (4), or in some of these elements, or in all.

The fixing elements (4) may also include interface fixing devices (16) between them and seals (30) or other interface materials to ensure an airtight closing of the moulds (13) (as shown in FIG. 14*d*).

Depending on the design criteria, the empty segments (3) may, for example, have no connection between them (see FIG. 16), in which case, in works front line there is no work with steel reinforcement material (9).

Empty segments (3) with steel reinforcement (9) which penetrate into the adjacent empty segment (as shown in view B-B of FIG. 14*d*) may alternatively be designed.

It is also possible to adopt, for example, a solution, shown in FIGS. 19*a* and 19*b*, with occasional introduction of overlapping reinforcement elements or overlaps (21) in situ, in the interfaces of the empty segments (3) or with other complementary located elements to be placed in situ that are deemed necessary (for example, seals or other). If that is the option, special solutions can be adopted of overlapping reinforcement elements of overlap or overlaps (21) of the empty segments (3), for example, threaded overlapping reinforcement elements or overlaps (21).

Alternatively, the overlapping reinforcement elements or overlaps (21) may travel with the empty segments (3) without being fixed, and it is possible to slide them when the empty segments (3) are already in their final position.

Figure 21:
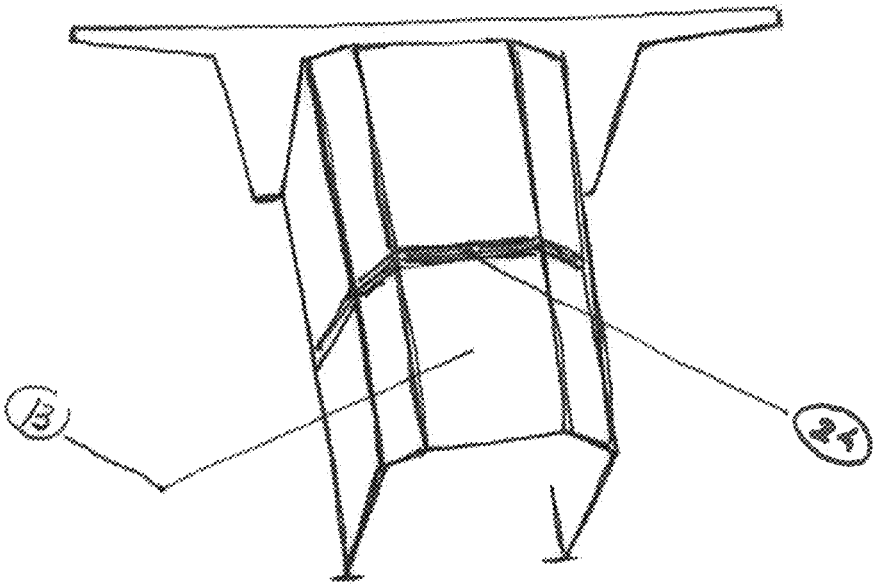
FIG. 21: use of mould closing elements (24) placed in situ to close the moulds (13) previously placed.

There may also be a design of fixing elements (4) and moulds (13) providing for the placement of closing moulds elements (24) in situ, schematically shown in FIG. 21. These closing moulds (24) may also be useful to facilitate the placement of overlapping reinforcement elements or overlaps (21).

Depending on the design of the fixing elements (4), after placement of the empty segments (3) part of the moulds can be introduced (13), for example, the inner moulds, which in the case of the fixing elements having a design similar to that shown in FIG. 14 is not necessary (since, in this case, the moulds are fully included in the fixing elements). The fixing elements (4) could also include only a part of the moulds (13), as shown in the example of FIGS. 9*a*-9*e*.

Finally, after all the empty segments have been placed (3) in the shoring system (6) and any additional works have been executed in situ as previously mentioned, in the case of the structure (1) being designed with prestressing, with the respective cables having an extension above the empty segments (3), then ducts (10) connecting elements must also be placed in situ, and the prestressing cables (11) must also be introduced in an in situ operation at the works front line, similarly to what happens in traditional construction with prefabricated segments.

The shoring system (6) may be prepared for the installation of lifting equipment (19) that allows the placement of prestressing coils under the deck. The installation of the prestressing cables is performed after the prestressing ducts sealing (10).

Phase C—Concreting of the Structural Element (1);

The operation of pouring the filling material (8), which in this example coincides with the concreting operation of the deck, may have very variable durations, and usually means several hours for the example being described. In this operation, a number of specialized operators will pour and vibrate the liquid concrete in all the empty segments (13) located between two consecutive construction joints (18), i.e. of a portion of the structure (1) to be constructed. Normally, as the extension to be executed in each cycle has, for example, dimension L (indicated in FIG. 15), this means that the sum of the lengths of empty segments (13) used in that span will also have, for example, the same L1 extension. It is possible to apply the method to other extensions of concreting.

The shoring system (6) which can be, for example and as already mentioned, self-launching scaffolding, can be equipped with elements that allow the creation of concreting circuits along the stretch to be constructed, for optimization of this process.

Note that the operation in question, in the example shown, is identical to the normal concreting operation of the in situ construction methodology, without any influence of 'segmentation' of the deck in that process, which is continuous and follows the normal rules of the state of the art for in situ concreting.

The same application principles apply if the filling material (8) is not concrete, but should also take into account the particularities of the material involved.

It should be noted that the filling of the empty segments (3), if there is more than one, does not imply the existence of the filling material discontinuities in the interface areas between empty segments (3).

If concrete accelerating admixtures (31) are incorporated in the fixing elements (4) or in the shoring systems (6) the curing periods may be shortened.

Phase D—Curing Period;

In the example shown, with structures in prestressed reinforced concrete, the curing period can mean dozens of hours and must be defined case by case, according to the rules of the state of the art for structures concreted in situ, and depending on the particular characteristics of the deck (or other structural member), for example, type of concrete, inclusion of prestressing or not, necessary resistance to the prestressing application and other common state of the art specifications that are applicable.

Depending on the conditions of the location of the works and the technical requirements, additional operations may be needed to ensure a proper curing, for example, watering the elements in consolidation.

In the case of filling material (8) is not concrete, the time of consolidation should be defined accordingly.

Phase E—Prestressing of the Structure (if any) and Removal of Scaffolding;

In the case where the structure (1) is, for example, prestressed, including elements of the prestressing type (10) and (11) or others, before the removal of the scaffolding takes place, the cables, or other prestressing elements, must be tensioned according to the tensioning plan provided for, and it can be a partial or total tensioning.

Then follows the removal of scaffolding of the structure (1), which is no more than disengaging the shoring system (6) from the weight of the part of the structure (1) being executed. This operation can be performed, for example, by manual or mechanical means, and can be done, for example, through a sequence of small localized operations, or through a single global operation with mechanical means designed for this purpose and known in the state of the art. This task may benefit from, for example, the use of an automatic control system of scaffolding deformations (6) depending on their structural response.

Normally, this operation is followed by the transposition of the shoring system (6) to the next portion of the structure (1), in this example to the next span of the structure (1) to be constructed. Where the shoring system (6) is self-launching scaffolding, this operation is the forward operation.

Phase F—Removal of the Fixing Elements (4) and Transport to Prefabrication Area (5).

At the same time, before or after the transposition of the shoring system (6) to a new position, a team of operators starts removing the fixing elements (4), which, for example, include the inner moulds (13).

If the fixing elements (4) have elements that trespass the filling material (8) as is the case of the fixing elements in Figurea 14*a*-14*d*, the fixing elements (4) must be separated into two or more parts.

Still based on FIGS. 14*a*-14*d*, the fixing elements, which in this example include the inner moulds (13) (for example, inner formwork) may, as mentioned, for example, include adjusting devices (15) that may facilitate their dismantling and removal.

This removal will also be easier if, as shown in FIG. 9*a*, the fixing elements (4) also include sliding devices (26) (for example, wheels) or/and if they include, for example, gripping systems (27), or if they include both.

In the case of the example shown, the construction of a prestressed reinforced concrete deck, carried out with empty segments (3) with fixing elements (4) including inner moulds (13) as, for example, retractable systems illustrated in FIG. 14, the fixing systems (4) may, for example, be removed from the interior of the box girder already constructed in the opening of the section (18) located at the works front line.

External auxiliary equipment (7), for example, or, also for example, auxiliary equipment (19) of the shoring system itself (6), may be used to facilitate the removal of the fixing elements (4) and placement in a means of transport (17) (with characteristics compatible with the type of supply previously defined) that will take them to the prefabrication area (5) where they will be used for the prefabrication of a new series of empty segments (3), thus starting a new cycle.

To increase productivity, it may be convenient to have a plurality of fixing elements sets (4) for each position. In such a way that, while a set of empty segments (3), including the respective fixing elements (4), is being used at the works front line, for the construction of the current stretch, another set (or more than one) of fixing elements (4) is in the prefabrication area (5) so that, at the same time, the next stretch is already being prefabricated, or several of the next stretches, if so defined.

In the case of using this process in overhead self-launching scaffolding, for example, a special pier segment (28) can be previously executed that, in addition to the components of an empty segment (3), can have incorporated, for example, a pre-slab and a frame of the shoring system (6). This special pier segment (28) may alternatively, and also for example, be a conventional prefabricated segment, already with filling material. In this case, this is the segment corresponding to 'segment 0'.

Figure 22:
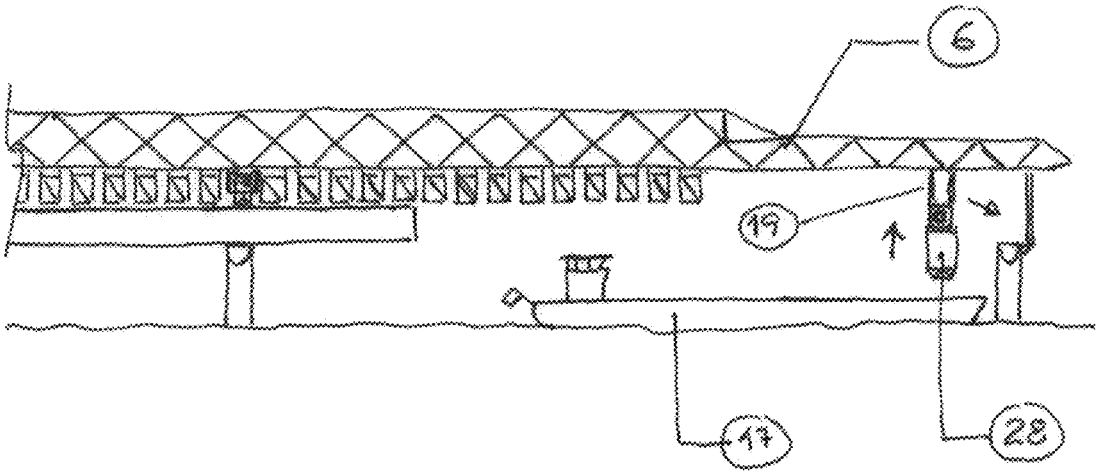
FIG. 22: special pier segments (28) placed on the pier prior to the start cycle of the respective span.
Figure 23:
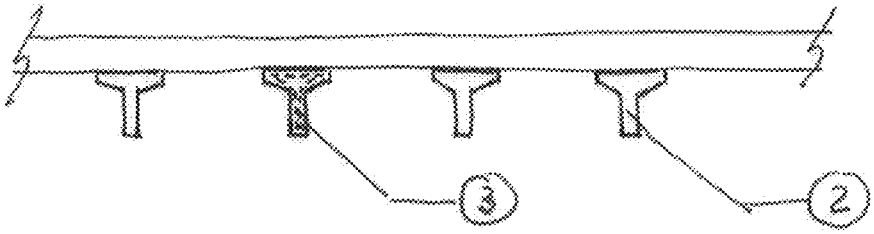
FIG. 23: cross-section of the structure to be constructed (1) with T elements.
Figure 24:
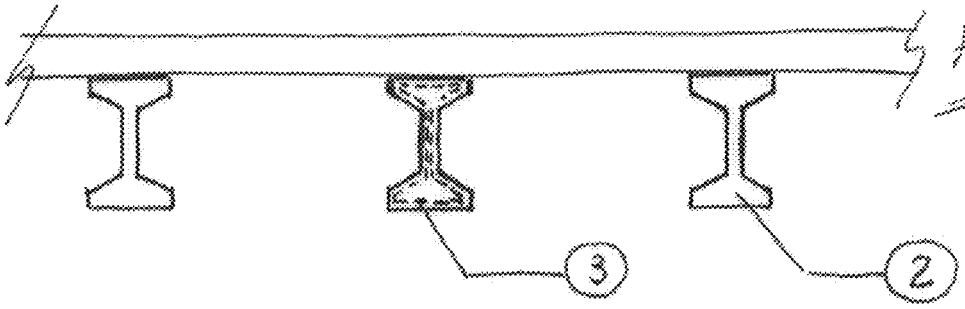
FIG. 24: cross-section of the structure to be constructed (1) with double flange elements.
Figure 25:
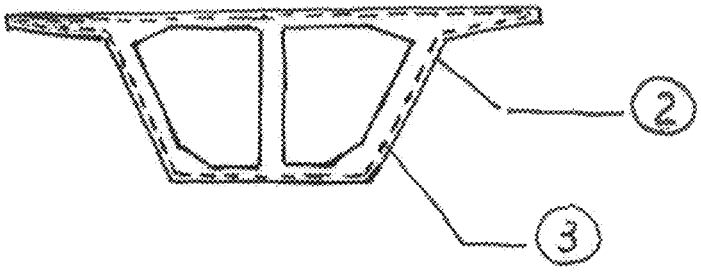
FIG. 25: cross-section of the structure to be constructed (1) with bi-cellular box elements.
Figure 26:
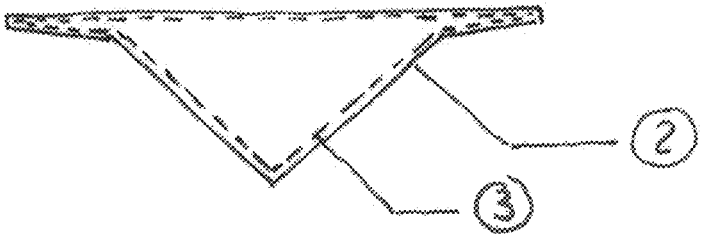
FIG. 26: cross-section of the structure to be constructed (1) with predominantly triangular elements.
Figure 27:
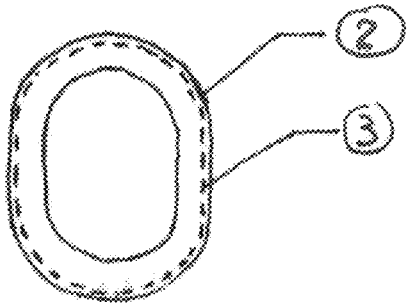
FIG. 27: cross-section of the structure to be constructed (1) of elements with oval sections.
Figure 28:
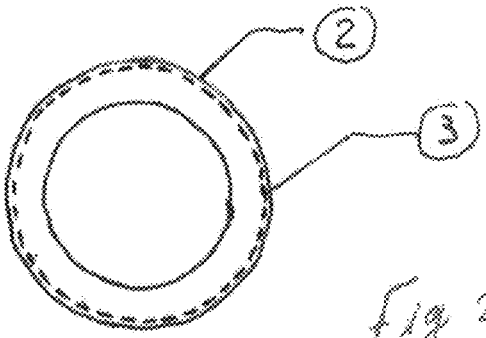
FIG. 28: cross-section of the structure to be constructed, with elements with circular sections.
Figure 29:
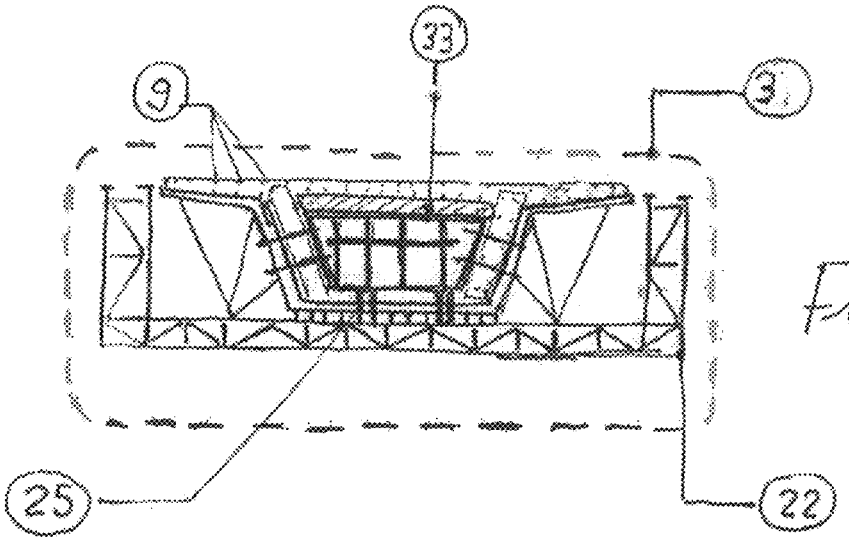
FIG. 29: empty segment with inclusion of prefabricated elements (33) (integral prefabricated elements, already with filling material).

In these special pier segments (28), the fixing element (4) can be different and need not have connections to the scaffolding, as can be seen in FIG. 22. The fixing element (4) may, for example, be provided with connections to allow opening so as to facilitate disassembling at the end of the deck stretch construction (1).

The construction process in accordance with the present invention can be applied in various types of shoring systems (6) (lower self-launching scaffolding, ground scaffolding, or others) simply by making the adaptations resulting from the characteristics of the shoring systems, with impact on the choice of means of transport (17) and in the design of the fixing elements (4), and may also influence the design of auxiliary equipment (19) of shoring systems (6). It is good project practice to develop the project with a simultaneous selection of the type of shoring system (6) to be adopted.

The application of the construction process in accordance with the present invention to reinforced concrete structures without prestressing (10) and (11) is in everything identical to that presented in this text, without the tasks/actions and elements related to the prestressing.

Figure 2:
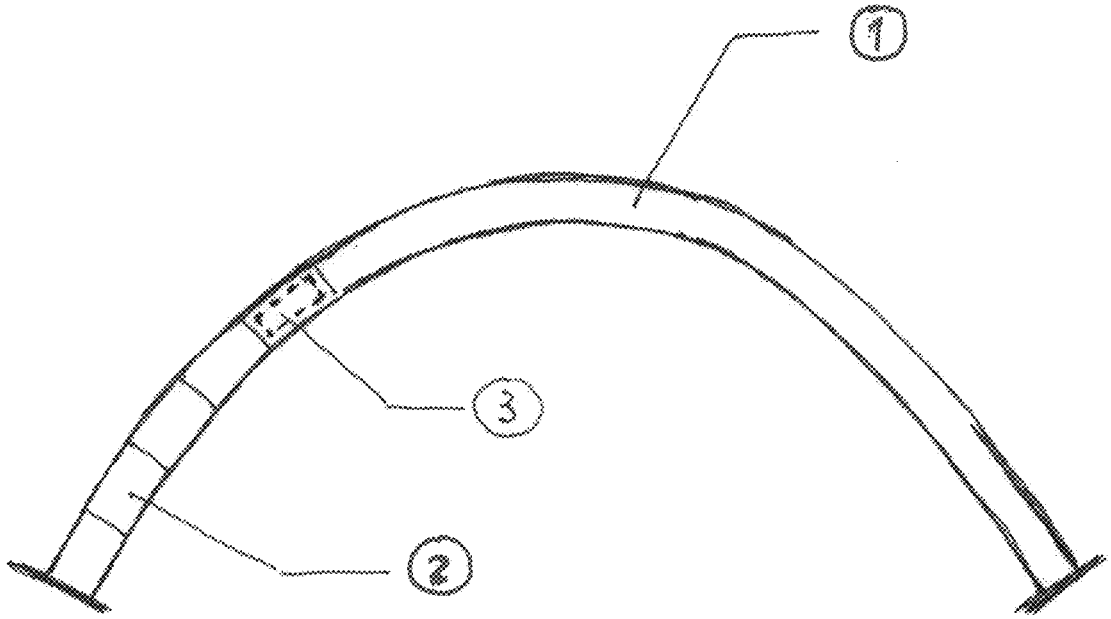
FIG. 2: structure (1) to be constructed of an arc, including identification of possible reference segments (2) and empty segments (3)
Figure 3:
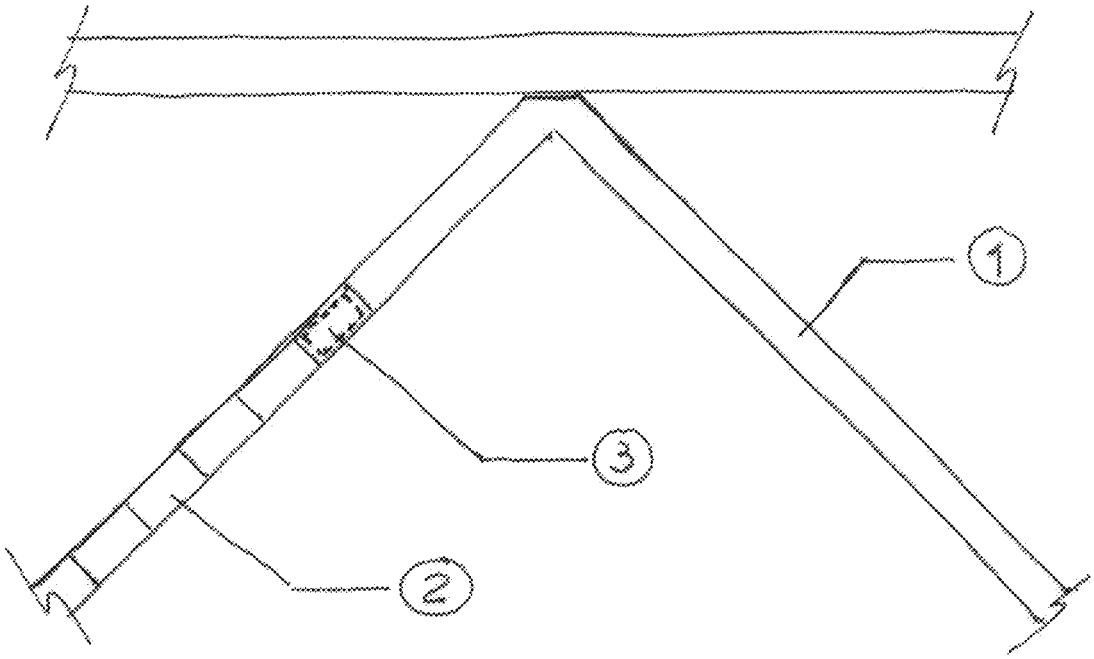
FIG. 3: structure (1) to be constructed with sloping elements, including identification of possible reference segments (2) and empty segments (3)
Figure 4:
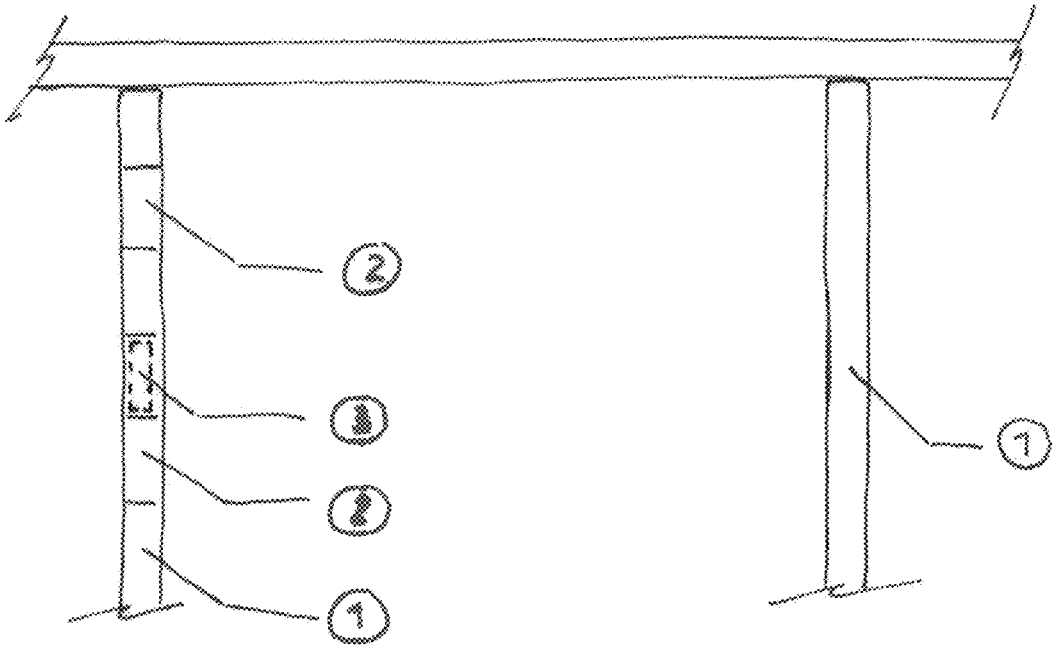
FIG. 4: structure (1) to be constructed of a pier, including identification of possible reference segments (2) and empty segments (3)
Figure 5:
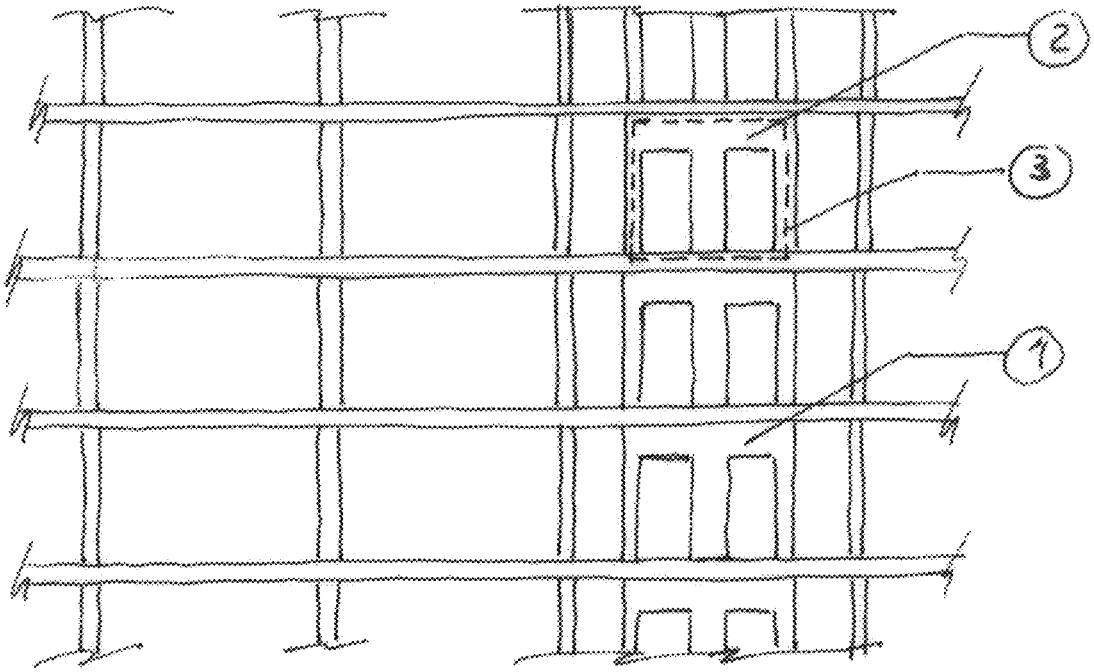
FIG. 5: structure (1) to be constructed of a rigid core of a building, including identification of possible reference segments (2) and empty segments (3)

In the construction of concrete structures, several structural systems, with several horizontal shapes can be executed by this method (see FIGS. 1 and 6), sloping structures (see FIG. 3), arched structures, see FIG. 2, vertical structures of piers (see FIG. 4), vertical structures of other elements with other shapes, for example, of concrete building cores (see FIG. 5), or other structures with other shapes in which it is possible to divide the structure to be built (1) into one or more reference segments (2) corresponding to the empty segments (3) (see FIG. 7).

Likewise, the construction process according to the present invention can be used in the construction of structures (1) of reinforced (and/or prestressed) concrete with different cross-sections, as for example the A-A cutaway section of FIG. 15*d*, the section of FIGS. 9*b* and 9*e*, the cross-sections of FIGS. 11*b* and 12*c*, the cross-sections of FIGS. 22 to 28, or the generic cross-section shown in FIG. 8, where the empty segments (3) assume configurations corresponding to the reference segments (2) of the structure (1) to be constructed.

In some cases, as in the example of FIGS. 11*a* and 11*b*, the empty segment (3) may incorporate a fixing element (4) with the structural capacity to cover the span, in which case dispensing the shoring system (6).

This method without shoring system (6) can also be applied in elements such as shown in FIGS. 12*a*-12*d*, wherein either because they are vertical elements, or because they are elements with a span compatible with the resistance of the fixing element (4), it becomes feasible to execute empty segments (3) which fit sequentially into each other, whereby the fixing elements (4) are dimensioned accordingly.

The application of the construction process in accordance with the present invention to structures (1) executed with other materials, for example, glass, ceramic, plastic or with hydraulic binders other than those used in reinforced concrete, is also possible provided the structure (1) to be constructed is divisible into one or more structure segments (2) and can justify and reveal advantages if this structure (1) is composite, either including steel reinforcement materials (9) or interface structures or inserts (12), and may also include or not, active reinforcement elements (11) and active reinforcement ducts (10), if necessary, and in which there are advantages to pouring the filling material (8) in situ in a place other than the place of prefabrication of the empty segments.

For example, this type of solution can be used to construct library or warehouse shelving made of plastic, with steel reinforcements (11) and/or rigid inserts (12), in plastic reservoirs with steel reinforcements (9) and/or active reinforcement (11), or glass structures with a wide span to be executed in situ, and that include steel reinforcements (9) and/or inserts (12), or, more generally, composite structures in which it is advantageous to pour the filling material (8) in situ.

LIST OF REFERENCE INDICES

1. Structure, to be constructed
2. Reference segment, of structure to be constructed
3. Empty segment
4. Fixing elements
5. Prefabrication area
6. Shoring system (scaffolding)
7. Auxiliary equipment (for cargo handling in the prefabrication area)
8. Filling material
9. Steel reinforcement elements
10. Prestressing ducts
11. Active reinforcement elements (prestressing cables)
12. Interface structure or 'insert'
13. Mould (for example formwork)
14. Handling device and/or positioning of the formwork
15. Mechanically adjustable elements (spindles, jacks, etc.)
16. Interface fixing devices (fixing devices or positioners, or positioner fixing devices)
17. Means of transport
18. Construction joint
19. Scaffolding auxiliary means (means of transport of loads)
20. Support elements of the shoring system
21. Overlapping elements or steel reinforcement overlaps
22. Rigid elements (of the fixing elements)
23. Position elements of steel reinforcement elements
24. Mould closing elements
25. Isolation Devices (trespass of filling material, negatives in the filling material)
26. Sliding devices
27. Gripping devices
28. Special pier segments
29. Prefabricated anchoring blocks
30. Seals or interface elements between segments
31. Concrete accelerating system (for example, by steam)
32. Reaction rigid elements for tensioning
33. Prefabricated elements

The invention claimed is:

1. A process for constructing at least part of a structure (1) configured to be divisible into one or more reference segments (2), comprising:

prefabricating empty segments (3), ex situ, configured with a geometry corresponding to a geometry of respective reference segments (2) and configured to receive a filling material (8), wherein the prefabricating of said empty segments (3) includes assembling steel reinforcements (9), fixing elements (4), first molds, and a system of rigid elements (22), wherein said fixing elements (4) are configured to stabilize said empty segments (3) during a transport phase from the ex situ location to an in situ location and to maintain stability of said empty segments (3) after placement at the in situ location, wherein said rigid elements (22) are configured to support said steel reinforcements (9) and said first molds (13) included with said fixing elements (4);

transporting of said empty segments (3) from the ex situ location to the in situ location;

placing said empty segments (3) in a final placement position corresponding to the respective reference segments (2) of said structure (1);

providing second molds to said empty segments after placing said empty segments in the final placement position;

filling said empty segments (3), after placement in the in situ location, with filling material (8) without discontinuity of said filling material (8) in existing interface areas between any two adjacent reference segments (2) of said structure (1);

consolidating the filling material (8) in order to obtain at least part of the structure (1) to be constructed, and removing said fixing elements (4), the first molds, and the second molds.

2. The process according to claim 1, wherein the prefabricating the empty segments (3) includes the assembling of prestressing ducts (10).

3. The process according to claim 1, further comprising:

in situ introduction of prestressing cables (11) after the in situ assembling of at least one of said empty segments (3), and carrying out a tensioning of said cables (11) in situ, after the filling of the filling material (8) and the consolidating of the filling material.

4. The process according to claim 1, further comprising:

designing the structure (1), which includes a verification of limit states and use in existing interface sections between any two adjacent reference segments (2) and not trespassed by the steel reinforcement elements (9).

5. The process according to claim 1, wherein the prefabricating of the empty segments (3) includes introducing prestressing cables (11) ex situ and carrying out a tensioning of the prestressing cables (11) in situ, after the filling with the filling material (8) and the consolidating of the filling material.

6. The process according to claim 1, wherein the prefabricating of the empty segments (3) includes assembling of at least one of the following: interface elements, inserts (12), including profiles of metallic material, carbon fiber (31), prefabricated anchoring blocks (29), other prefabricated elements (33), positioning elements of the steel reinforcements, or isolation devices (25) for execution of negatives in the filling material (8).

7. The process according to claim 1, wherein the prefabricating of the empty segments (3) includes assembling of seals (30) adapted to be arranged as interface elements between the first molds (13), or the second molds, or other interface elements to be arranged between said empty segments (3).

8. The process according to claim 1, further comprising assembling additional steel reinforcements (21) in said empty segments (3) in the in situ location.

9. The process according to claim 1, wherein the prefabricating of said empty segments (3) includes:

providing prestressing cables (11) to said empty segments in the ex situ location, and tensioning of the prestressing cables (11) in the ex situ location, and after the transporting of the empty segments to the in-situ location, pre-tensioning transmission of said fixing elements (4) to the filling material (8).

10. The process according to claim 1, further comprising:

in situ removal of the fixing elements (4) and part or all of said first molds and said second molds;

transporting said fixing elements (4) back to a prefabrication area of the ex situ location (5);

starting a next cycle of prefabricating.

11. The process according to claim 1, further comprising ex situ assembling of a plurality of sets of the fixing elements (4), in order to allow more than one front of prefabrication of empty segments (3).

12. The process according to claim 1, wherein the prefabricating of said empty segments (3) is executed separately from and at least partly simultaneously with the construction of at least part of the structure (1) using structure segments corresponding to reference segments (2) or special pier segments (28).

* * * * *